US010633749B2

(12) United States Patent
Jackson et al.

(10) Patent No.: US 10,633,749 B2
(45) Date of Patent: Apr. 28, 2020

(54) ELECTROLYZER REACTOR AND RELATED METHODS

(71) Applicant: BOARD OF TRUSTEES OF MICHIGAN STATE UNIVERSITY, East Lansing, MI (US)

(72) Inventors: James E. Jackson, Haslett, MI (US); Chun Ho Lam, East Lansing, MI (US); Christopher M. Saffron, Okemos, MI (US); Dennis J. Miller, Okemos, MI (US)

(73) Assignee: BOARD OF TRUSTEES OF MICHIGAN STATE UNIVERSITY, East Lansing, MI (US)

( * ) Notice: Subject to any disclaimer, the term of this patent is extended or adjusted under 35 U.S.C. 154(b) by 352 days.

(21) Appl. No.: 14/806,314

(22) Filed: Jul. 22, 2015

(65) Prior Publication Data

US 2016/0024669 A1 Jan. 28, 2016

Related U.S. Application Data

(60) Provisional application No. 62/028,160, filed on Jul. 23, 2014.

(51) Int. Cl.

| | |
|---|---|
| ***C25B 3/00*** | (2006.01) |
| ***C25B 3/04*** | (2006.01) |
| ***C25B 9/08*** | (2006.01) |

(52) U.S. Cl.

CPC . *C25B 3/04* (2013.01); *C25B 9/08* (2013.01)

(58) Field of Classification Search

CPC ..... C25B 3/04

(Continued)

(56) References Cited

U.S. PATENT DOCUMENTS

| | | | |
|---|---|---|---|
| 4,584,139 | A | 4/1986 | Gray et al. |
| 5,225,581 | A | 7/1993 | Pintauro |

(Continued)

FOREIGN PATENT DOCUMENTS

| | | | |
|---|---|---|---|
| WO | WO-1998/021298 | A1 | 5/1998 |
| WO | WO-2012/012799 | A1 | 1/2012 |
| WO | WO-2013/134220 | A1 | 9/2013 |

OTHER PUBLICATIONS

Saez et al., "Electrocatalytic Hydrogenation of Acetophenone Using a Polymer Electrolyte Membrane Electrochemical Reactor," Electrochimica Acta (2013), vol. 91, pp. 69-74. (Year: 2013).*

(Continued)

*Primary Examiner* — Edna Wong

(74) *Attorney, Agent, or Firm* — Marshall, Gerstein & Borun LLP

(57) ABSTRACT

The disclosure relates to an electrolyzer reactor suitable for the reduction of organic compounds. The reactor includes a membrane electrode assembly with freestanding metallic meshes which serve both as metallic electrode structures for electron transport as well as catalytic surfaces for electron generation and organic compound reduction. Suitable organic compounds for reduction include oxygenated and/or unsaturated hydrocarbon compounds, in particular those characteristic of bio-oil (e.g., alone or a multicomponent mixtures). The reactor and related methods provide a resource- and energy-efficient approach to organic compound reduction, in particular for bio-oil mixtures which can be conveniently upgraded at or near their point of production with minimal or no transportation.

26 Claims, 8 Drawing Sheets

(58) Field of Classification Search
USPC ..... 205/450, 455, 413; 208/46
See application file for complete search history.

(56) References Cited

U.S. PATENT DOCUMENTS

| | | | | |
|---|---|---|---|---|
| 5,272,017 | A | 12/1993 | Swathirajan et al. | |
| 5,866,734 | A | 2/1999 | Flick et al. | |
| 5,919,349 | A * | 7/1999 | Huber | C25B 3/04 204/292 |
| 6,218,556 | B1 * | 4/2001 | Pintauro | C11C 3/12 204/167 |
| 6,294,068 | B1 | 9/2001 | Petrovic et al. | |
| 6,825,367 | B2 | 11/2004 | Lalvani et al. | |
| 8,002,969 | B2 | 8/2011 | Hamad | |
| 8,383,871 | B1 * | 2/2013 | Sellars | C10L 3/08 208/67 |
| 2007/0259236 | A1 * | 11/2007 | Lang | H01M 4/8605 429/448 |
| 2008/0032174 | A1 * | 2/2008 | Fuglevand | H01M 4/8605 429/414 |
| 2011/0266142 | A1 | 11/2011 | Norman et al. | |
| 2013/0087451 | A1 | 4/2013 | Hirashige et al. | |
| 2014/0110268 | A1 | 4/2014 | Jackson et al. | |

OTHER PUBLICATIONS

Cheng et al., "Electrochemical Hydrodehalogenation of Chlorinated Phenols in Aqueous Solutions," Journal of the Electrochemical Society (2003), vol. 150, No. 2, pp. D17-D24. (Year: 2003).*

Wang et al., "Research of Special-Shaped Membrane Electrode Assembly for Direct Methanol Fuel Cell," Key Engineering Materials (2011), vol. 464 (Functional Manufacturing Technologies and Ceeusro II), pp. 409-413. (Year: 2011).*

An, et al., "The Electrochemical Hydrogenation of Edible Oils in a Solid Polymer Electrolyte Reactor. I. Reactor Design and Operation," JAOC, 75(8):917-25 (1998).

Jang, et al., "Hydrogenation for Low Trans and High Conjugated Fatty Acids," Compr. Rev. Food Sci. Food Saf., 1:22-30 (2005).

Lam, "Electrocatalytic Upgrading of Bio-Oil Model Compounds in a Solid Polymer Electrolyte Electrolyer (SPEE)," presented at 246th American Chemical Society Meeting in Indianapolis, IN on Sep. 12, 2013, 17 pages.

Mondal, et al., "Mediator-Assisted Electrochemical Hydrogenation of Soybean Oil," 14 pages (2005).

Sundmacher, et al., "Solid Electrolyte Membrane Reactors: Status and Trends," *Catalysis Today,* 104:185-99 (2005).

Henika, et al., "Optimization of a Flow Electrolyzer," presented at Michigan State University Undergraduate Research Symposium on Jul. 24, 2013, 1 page.

Henika, et al., "Optimization of a High Pressure Flow Electrolyzer," presented at Michigan State University Undergraduate Research Symposium on Jul. 23, 2014, 1 page.

* cited by examiner

ELECTROLYZER REACTOR AND RELATED METHODS

CROSS-REFERENCE TO RELATED APPLICATIONS

Benefit is claimed to U.S. Provisional Application No. 62/028,160 (filed on Jul. 23, 2014), which is incorporated herein by reference in its entirety.

STATEMENT OF GOVERNMENT INTEREST

None.

BACKGROUND OF THE DISCLOSURE

Field of the Disclosure

The disclosure relates to an electrolyzer reactor suitable for the reduction of organic compounds (e.g., oxygenated and/or unsaturated hydrocarbon compounds, for example a bio-oil mixture). The reactor includes a membrane electrode assembly with freestanding metallic meshes which serve both as metallic electrode structures for electron transport as well as catalytic surfaces for hydrogen atom formation and organic compound reduction.

BRIEF DESCRIPTION OF RELATED TECHNOLOGY

While reduction and hydrogenation are practiced widely in the petroleum and pharmaceutical industries, a particularly pressing need is for byproduct-free reactions that hydrogenate and deoxygenate renewable materials to enable them to replace non-renewable petroleum as the foundation for chemicals and fuels manufacture. Biomass fast pyrolysis-derived bio-oil is a liquid mixture containing hundreds of organic compounds with chemical functionalities that are corrosive to container materials and are prone to polymerization. After aging during storage or transit, the properties of bio-oil change which renders the mixture incompatible with the existing U.S. energy infrastructure. Stabilization and upgrading of the bio-oil into a more stable form is required.

Fast pyrolysis (e.g., 400-600° C. for a few seconds) is a simple method that "melts" biomass into a complex mixture of molecular fragments. The liquid "bio-oil" product can be formed in yields of up to 70%, with gases and char accounting roughly equally for the other 30%. This liquid is a complex mix of sugar and sugar ester fragmentation and dehydration products (e.g. hydroxyacetaldehyde, furfural, hydroxymethylfurfural, levoglucosan, acetic acid), along with phenolic lignin subunits (e.g. guaiacol and syringol). Raw bio-oil is unusable as a transportation fuel, due to its high reactivity, acidity (e.g., about pH 2-3), and water content. With oxygen:carbon ratios (e.g., about 1:1) and specific energy values like biomass itself, bio-oil's energy content is only about ⅓ that of hydrocarbons (e.g., 15 vs. 45 MJ/kg). Moreover, bio-oil's high content of reactive acid, carbonyl and phenolic compounds make it prone to polymerization and oxidation.

Electrocatalytic hydrogenation (ECH) is a general technique for reduction of organic compounds. By electrochemically combining protons ($H^+$ ions) obtained from water ($H_2O$) with electrons from an attached circuit, the method forms hydrogen on the catalytic surface, which then delivers the hydrogen to the organic substrates without the need for addition of chemical reducing agents such as $NaBH_4$, $LiAlH_4$, or gaseous $H_2$ itself. Typically, ECH reactions are performed in an electrochemical cell with separate compartments for the anode (oxidizing) and catalytic cathode (reducing) electrodes. Conventional ECH offers mild conditions (e.g., 1 atm, modest temperatures) but it does require the presence of salts (or other ionic agents) to make the solution conductive. This requirement adds cost, both for the salts, and due to the need for post-reaction salt extraction (recycling). Extra components in the mix also introduce possible side reactions.

SUMMARY

The use of a solid polymer electrolyte (SPE)-based electrolyzer cell can bypass ionic electrolyte solutions and hence reduces or eliminates the need for salt separation and recycling. This disclosure relates to an SPE electrolyzer and related methods for the reduction of organic compounds, for example by electrocatalytic hydrogenation (ECH) and/or electrocatalytic hydrodeoxygenation (ECHDO). ECH/ECHDO operates under mild conditions, at atmospheric pressure, below the boiling point of the medium (typically water), and with a minimum of need for added reagents. This type of conversion stabilizes and upgrades bio-oil by converting oxygen-containing functionalities and unsaturated carbon-carbon bonds into chemically reduced forms with increased hydrogen content and reduced reactivity. The stabilized, reduced bio-oils have decreased reactivity and increased specific energy content (MJ/'kg), a form that can be stored and transported using metal containers and pipes. The stabilization and energy upgrading extend to full hydrogenation and deoxygenation, serving as a refining path from biomass-derived liquids to fuel and chemical-grade hydrocarbons and oxygenates.

In addition to the advantages of ECH/ECHDO (e.g., mild temperature and pressure conditions, avoidance of the use of $H_2$ gas), the solid polymer electrolyte (SPE) electrolyzer has several distinct features that is make it particularly suitable for the reduction of organic compounds (generally) and for upgrading of bio-oil (more specifically), including: (a) Versatility: Bio-oil contains mostly organic compounds and variable amounts of water, depending on feedstock. Thus it is difficult to maintain consistent electrolyte concentrations in different batches. The SPE method enables the use of ECH/ECHDO without electrolyte (e.g., in the catholyte/on the cathode-side of the cell), making it insensitive to this variability. (b) Resource economy: Because the SPE system avoids the use of ionic electrolytes in the cathode compartment, costs of reagents and separation steps are minimized. (c) Energy economy: The two electrodes in a SPE electrolyzer contact the surface of the membrane. This minimizes the internal resistance of the electrolyzer to the greatest extent. Lower internal resistance requires less voltage which implies less energy input for the upgrading. (d) Electricity storage: The ability to link electrical energy to the chemical energy embodied in the above reduction products represents a mechanism to store power that comes from a renewable source (e.g., wind turbines, solar collectors, etc.) whose production does not match the demand curve for electrical energy. Such electrical-chemical energy linkages provide an important buffering in timing and enhancing the value of renewable-resource power generation systems.

In one aspect, the disclosure relates to an electrolyzer reactor comprising: (a) a membrane electrode assembly comprising: (i) a proton exchange membrane (PEM) having a first surface and a second surface opposing the first surface, (ii) a freestanding first metallic mesh in physical contact with the first PEM surface and having electrocatalytic activity for water oxidation and hydrogen ion formation, and (iii) a freestanding second metallic mesh in physical contact with the second PEM surface and having electrocatalytic activity for reduction of one or more organic compounds, wherein the first metallic mesh and the second metallic mesh are in electrical contact with each other and optionally with a voltage source for driving electrons therebetween; (b) a first reaction volume in fluid communication with (i) the first metallic mesh and (ii) the first PEM surface; and (c) a second reaction volume in fluid communication with (i) the second metallic mesh and (ii) the second PEM surface. Suitably, the first reaction volume is defined by a first housing; and the second reaction volume is defined by a second housing. In an embodiment, the reactor further comprises a voltage source in electrical connection with the first metallic mesh and the second metallic mesh, the voltage source being adapted to driving electrons therebetween.

Various refinements of the electrolyzer reactor are possible. For example, the first metallic mesh and the second metallic mesh can be free from additional catalytic materials thereon. In an alternative refinement, at least one of the first metallic mesh and the second metallic mesh comprises a further catalytic material thereon. In another refinement, (i) the first metallic mesh comprises stainless steel; and (ii) the second metallic mesh comprises alloy comprising copper and nickel. Suitably, the second metallic mesh has electrocatalytic activity for catalyzing at least one of (i) ECH of unsaturated carbon-carbon bonds in an organic substrate, (ii) ECH of carbon-oxygen double bonds in an organic substrate, and (iii) ECHDO of carbon-oxygen single bonds in an organic substrate. In a refinement, the second metallic mesh has electrocatalytic activity for reduction of one or more organic compounds comprising one or more functional groups selected from the group consisting of carbonyl carbon-oxygen double bonds, aromatic double bonds, ethylenic carbon-carbon double bonds, acetylenic carbon-carbon triple bonds, hydroxyl carbon-oxygen single bonds, ether carbon-oxygen single bonds, and combinations thereof. In another refinement, the first metallic mesh comprises at least one metal component having electrocatalytic activity for reduction of the one or more organic compounds. In another refinement, the first metallic mesh and the second metallic mesh each comprise the same metal. In another refinement, the proton exchange membrane (PEM) comprises a perfluorocarbon sulfonate polymer.

In a particular refinement, the (i) the PEM is in the form of a tube, the first PEM surface being the tube interior surface and the second PEM surface being the tube exterior surface; (ii) the PEM tube defines the first reaction volume as a tubular volume containing the first metallic mesh therein; and (iii) the second reaction volume is defined by an outer shell as an annular volume between the outer shell and the PEM tube and containing the second metallic mesh therein. In other variations, the first metallic mesh and/or the second metallic mesh are alternatively replaced by first and/or second free metallic powder packings (e.g., unsupported or supported on any of a variety of support substrates such as carbon cloth) in the first reaction volume and/or the second reaction volume, respectively. In other variations, the first reaction volume includes an electrode wire, for example in addition to or as a replacement for the first metallic mesh or the first metallic powder packing.

For example, in another aspect, the disclosure relates to an electrolyzer reactor comprising: (a) a membrane electrode assembly comprising: (i) a proton exchange membrane (PEM) having a first surface and a second surface opposing the first surface, (ii) a first metallic surface having electrocatalytic activity for water oxidation and hydrogen ion formation, the first metallic surface being selected from the group consisting of a freestanding first metallic mesh in physical contact with the first PEM surface, a freestanding first metallic powder packing in physical contact with the first PEM surface, and an electrode wire, and (iii) a second metallic surface having electrocatalytic activity for reduction of one or more organic compounds, the second metallic surface being selected from the group consisting of a freestanding second metallic mesh in physical contact with the second PEM surface and a freestanding second metallic powder packing in physical contact with the second PEM surface, wherein the first metallic surface and the second metallic surface are in electrical contact with each other and optionally with a voltage source for driving electrons therebetween; (b) a first reaction volume in fluid communication with (i) the first metallic surface and (ii) the first PEM surface; and (c) a second reaction volume in fluid communication with (i) the second metallic surface and (ii) the second PEM surface; wherein: (i) the PEM is in the form of a tube, the first PEM surface being the tube interior surface and the second PEM surface being the tube exterior surface; (ii) the PEM tube defines the first reaction volume as a tubular volume containing the first metallic surface therein; and (iii) the second reaction volume is defined by an outer shell as an annular volume between the outer shell and the PEM tube and containing the second metallic surface therein.

In another aspect, the disclosure relates to a method for reducing organic compounds (e.g., upgrading fast pyrolysis bio-oil), the method comprising: (a) providing the reactor of any of the foregoing claims; (b) applying a voltage potential to a voltage source in electrical connection with the first metallic mesh and the second metallic mesh to drive electrons from the first metallic mesh to the second metallic mesh; (c) supplying water to the first reaction volume, thereby oxidizing the water to form oxygen, hydrogen ions transported to the second reaction volume through the PEM, and electrons transported from the first metallic mesh to the second metallic mesh; and (d) supplying at least one reducible organic compound to the second reaction volume, thereby reducing the organic compound (e.g., a plurality of different organic reactants to be reduced, for example via ECH/ECHDO). In a refinement, the method further comprises recovering or separating the reduced organic compound reaction product from the second reaction volume. In a refinement, the method further comprises recovering or separating hydrogen gas generated during organic compound reduction from the second reaction volume and feeding the hydrogen gas to a biomass fast pyrolysis reactor.

Various refinements of the organic reduction method are possible. For example, the water supplied to the first reaction volume can comprise an electrolyte. In a refinement, water is supplied to the to the second reaction volume along with the organic compound reactants. In another refinement, the second reaction volume is free from added electrolytes. In another refinement, the reducible organic compound supplied to the second reaction volume comprises one or more functional groups selected from the group consisting of carbonyl carbon-oxygen double bonds, aromatic double bonds, ethylenic carbon-carbon double bonds, acetylenic carbon-carbon triple bonds, hydroxyl carbon-oxygen single bonds, ether carbon-oxygen single bonds, and combinations thereof. In another refinement, the method comprises supplying a plurality of reducible organic compounds to the second reaction volume, the plurality being selected from the group consisting of a multicomponent bio-oil, a multicomponent bio-oil fraction, a plurality of bio-oil components, and combinations thereof; wherein the reduced organic compound reaction product comprises an upgraded bio-oil product. In another refinement, the method comprises supplying a plurality of bio-oil pyrolysis products to the second reaction volume, the plurality being selected from the group consisting of acetol, hydroxyacetaldehyde, glyoxal, formaldehyde, acetic acid, phenol, guaiacol, syringol, levoglucosan, furfural, glucose, xylose, substituted derivatives thereof, and combinations thereof. In another refinement, the reduced organic compound reaction product comprises one or more of ethylene glycol, propylene glycol, cyclohexanol, furfuryl alcohol, and methanol. In another refinement, the method comprises supplying a plurality of reducible organic compounds to the second reaction volume, the plurality being selected from the group consisting of a multicomponent lignin depolymerization product, a multicomponent lignin depolymerization product fraction, a plurality of lignin depolymerization product components, and combinations thereof. In another refinement, the method comprises performing the organic compound reduction reaction at a temperature ranging from 0° C. to 100° C. and at a pressure ranging from 0.8 atm to 1.2 atm.

While the disclosed apparatus, methods, and compositions are susceptible of embodiments in various forms, specific embodiments of the disclosure are illustrated (and will hereafter be described) with the understanding that the disclosure is intended to be illustrative, and is not intended to limit the claims to the specific embodiments described and illustrated herein.

BRIEF DESCRIPTION OF THE DRAWINGS

For a more complete understanding of the disclosure, reference should be made to the following detailed description and accompanying drawings wherein.

DETAILED DESCRIPTION

The disclosure relates to an electrolyzer reactor suitable for the reduction of organic compounds. The reactor includes a membrane electrode assembly with freestanding metallic meshes which serve both as metallic electrode structures for electron transport as well as catalytic surfaces for electron generation and organic compound reduction. Suitable organic compounds for reduction include oxygenated and/or unsaturated hydrocarbon compounds, in particular those characteristic of bio-oil (e.g., alone or a multicomponent mixtures). The reactor and related methods provide a resource- and energy-efficient approach to organic compound reduction, in particular for bio-oil mixtures which can be conveniently upgraded at or near their point of production with minimal or no transportation.

Electrolyzer Reactor

Figure 1:
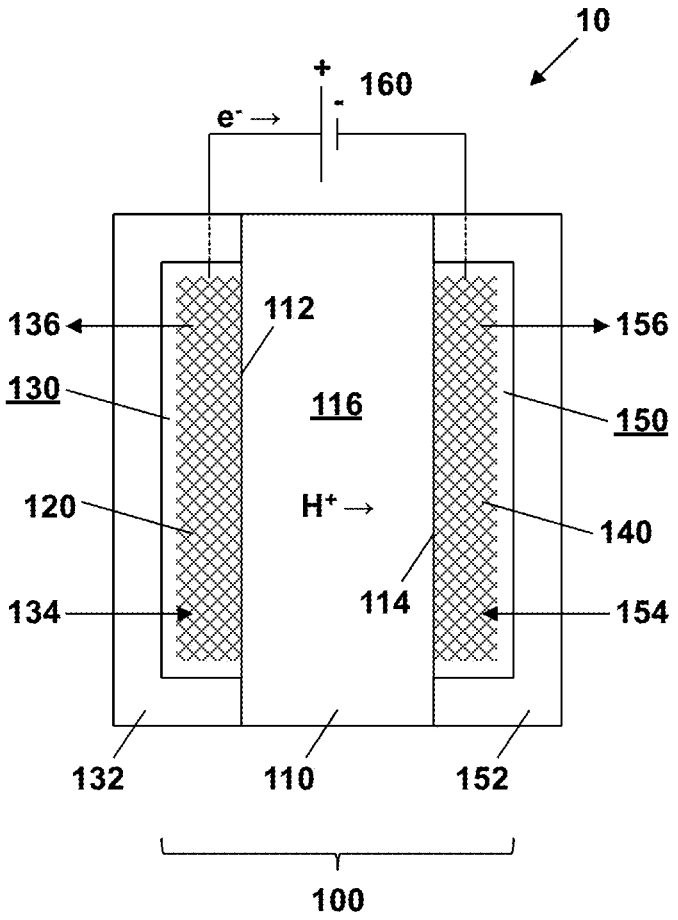
FIG. 1 is a side cross sectional view of an electolyzer reactor according to the disclosure and having a generally planar geometry for its proton exchange membrane in addition to first and second metallic meshes.

FIG. 1 is a side cross sectional view illustrating an electrolyzer reactor 10 according to the disclosure.

The reactor 10 includes a membrane electrode assembly 100 which further includes proton exchange membrane (PEM) 110 in having a first metallic mesh 120 (e.g., serving as an anode for the reactor) and a second metallic mesh 140 (e.g., serving as a cathode for the reactor) on opposing sides. As illustrated, the PEM 110 has a generally planar geometry with first and second opposing surfaces 112, 114 and an interior volume 116 therebetween. The PEM 110 is a semi-permeable membrane permitting cation transfer between the first and second opposing surfaces 112, 114, for example from the first surface 112 to the second surface 114 (as indicated by the arrow) during normal operation of the reactor 10. The first metallic mesh 120 is a freestanding body that is in physical contact with the first PEM surface 112 and has electrocatalytic activity for water oxidation and hydrogen ion formation. Similarly, the second metallic mesh 140 is a freestanding body that is in physical contact with the second PEM surface 114 and has electrocatalytic activity for activity for reduction of one or more organic compounds to corresponding reduced reaction products (e.g., hydrogenated and/or deoxygenated products corresponding to unsaturated and/or oxygenated organic compounds). The metallic meshes 120, 140 contact their respective PEM surfaces 112, 114 (e.g., directly adjacent thereto), but they are suitably not fixedly attached to the surfaces 112, 114 (e.g., not hot-pressed to the PEM 110, free from an adhesive or other binding agent). The metallic meshes 120, 140 suitably are held in place adjacent the PEM 110 via a suitable mechanical means such as an enclosure portion of the reactor 10 (e.g., first and second housings 132, 152 as illustrated). The absence of a fixed attachment between the metallic meshes 120, 140 and the PEM 110 facilitates removal and/or replacement of the meshes 120, 140 from the reactor 10 independently of the PEM 110. Further, the flexible, freestanding nature of the meshes 120, 140 allows them to expand, contract, or otherwise conform to changes in shape/size of the PEM 110 as a result of swelling or contraction of the PEM 110 (e.g., from contact with aqueous process fluids and drying after same). In contrast, hot-pressed or otherwise fixedly attached catalytic electrode materials are prone to damage and/or delamination from the PEM 110 when the PEM 110 deforms.

The reactor 10 further includes first and second reaction volumes 130, 150 to accommodate the inflow and outflow of reactants and products (e.g., in batch, semi-batch, or continuous operation) from the reactor 10 and to contain the metallic meshes 120, 140. As illustrated, the first reaction volume 130 is defined by a first housing 132 (e.g., which at least partially encloses the first metallic mesh 120) and the second reaction volume 150 is defined by a second housing 152 (e.g., which at least partially encloses the second metallic mesh 140). The housings 132, 152 can be formed from plastic or other suitable rigid material, and the housings 132, 152 (or components thereof) can be suitably sized and shaped such that they are in contact with their respective meshes 120, 140 and maintain them in contact with the PEM 110. The first reaction volume 130 is in fluid communication with the first metallic mesh 120 and the first PEM surface 112 (e.g., fluid species in the first reaction volume 130 can contact the first metallic mesh 120 and the first PEM surface 112). Similarly, the second reaction volume 150 is in fluid communication with the second metallic mesh 140 and the second PEM surface 114 (e.g., fluid species in the second reaction volume 150 can contact the second metallic mesh 140 and the second PEM surface 114). An inlet 134 and outlet 136 permit fluid inflow and outflow, respectively, to and from the first reaction volume 130. An inlet 154 and outlet 156 permit fluid inflow and outflow, respectively, to and from the second reaction volume 150. The reactor 10 can include multiple inlets and/or outlets for each reaction volume 130, 150 (e.g., more than the single inlet and outlet illustrated per reaction volume), and the inlets and outlets can be suitably positioned for continuous concurrent or countercurrent flow through the reaction volumes 130, 150 during operation.

As illustrated, the first metallic mesh 120 and the second metallic mesh 140 are in electrical contact with each other to provide an electrical path for electrons generated at the first metallic mesh 120 (e.g., servings as the anode) to travel to the second metallic mesh 140 (e.g., serving as the cathode) for organic compound reduction. The reactor 10 can include an electrical voltage source 160 in electrical connection with the meshes 120, 140 for driving electrons therebetween (e.g., from the first mesh 120 to the second mesh 140). The voltage source 160 can be a conventional electrical power supply and/or a battery, which (for example) can be coupled to a renewable electrical energy source such as a solar panel or wind turbine. For example, portions of the meshes 120, 140 may extend to the exterior of the reactor 10, or wire leads connected to the voltage source 160 may extend through the housings 132, 152 into the reaction volumes 130, 150 to contact the meshes 120, 140.

The proton exchange membrane (or polymer electrolyte membrane; PEM) 100 is a semi-permeable membrane including one or more ionomers and which are capable of conducting protons (e.g., in addition to other cations such as metallic cations) while being generally impermeable to gases (e.g., oxygen, hydrogen) and/or liquids (e.g., water, water-containing aqueous media on opposing membrane sides). Thus, the PEM serves to transport protons generated on the anode side of the reactor to the cathode side for organic compound reduction.

Suitable PEM materials include perfluorocarbon sulfonate polymers, such as those with a tetrafluoroethylene backbone and perfluorovinyl ether side chains terminated with sulfonate groups (e.g., NAFION membranes available from DuPont). More generally, polymer electrolytes for the PEM material can include perfluorocarbon sulfonates or materials which have doped or bound chemically and fixed proton donor such as sulfonate groups, phosphonate groups and carboxyl groups to polystyrene, polyether ketone, polyetherether ketone, polysulfone, polyethersulfone, polyetherethersulfone, or other engineering plastic materials. Suitable polymer materials exhibiting proton conductivity include sulfonated or alkylene-sulfonated fluorine-based polymers and polystyrenes which are represented by perfluorocarbon-based sulfonate resins and polyperfluorostyrene-based sulfonate resins. In addition, composite electrolytes of polymer materials can be used.

The first and second metallic meshes 120, 140 are generally flexible materials that can be formed from metallic wires in any suitable pattern, such as in a rectangular or square screen pattern. Suitably any standard mesh size from 16, 30, 60, or 100 mesh to 100, 200, 300, or 400 mesh can be used (e.g., with mesh openings from at least 30, 50, 70, or 100 micron and/or up to 100, 250, 500, or 1000 micron and wire thicknesses of 20, or 50 micron to 100 or 500 micron). In various embodiments, metals for either mesh can include Ru, Ni, Fe, Cu, Pt, Pd, Rh, Ir, Re, Os, Ag, Au, Co, Mo, Ga, Ti, Mn, Zn, V, Cr, W, Sn, mixtures thereof, alloys thereof, and combinations thereof, for example as the metal(s) forming the primary mesh structure (e.g., wires). In particular embodiments, the first metallic mesh 120 is a stainless steel mesh and/or the second metallic mesh 140 is formed from a copper-nickel alloy (e.g., a MONEL alloy). In other embodiments, the first metallic mesh 120 and the second metallic mesh 140 each share at least one common metal (e.g., each contains a common metal, such as nickel in stainless steel and in a copper-nickel alloy), in particular where the common metal has electrocatalytic activity for reduction of the organic compounds. In other embodiments, the first metallic mesh 120 includes at least one metal component having electrocatalytic activity for reduction of the organic compounds (e.g., which metal component may be absent from the second metallic mesh 140). In either case, the metal component of the first metallic mesh 120 having electrocatalytic activity for reduction of the organic compounds can undergo (i) oxidation in the anode compartment, (ii) transport across the PEM 110, and (iii) deposition on the second metallic mesh 140 during reactor 10 operation to further enhance the catalytic activity of the second metallic mesh (e.g., by providing a fresh catalytic surface). The first metallic mesh 120 has electrocatalytic activity for water oxidation and hydrogen ion formation, and the second metallic mesh 140 has electrocatalytic activity for activity for reduction of one or more organic compounds. In a refinement, the second metallic mesh 140 includes materials having electrocatalytic activity for catalyzing at least one of (i) ECH of unsaturated carbon-carbon bonds in an organic substrate, (ii) ECH of carbon-oxygen double bonds in an organic substrate, and (iii) ECHDO of carbon-oxygen single bonds in an organic substrate. For example, the second metallic mesh 140 can have electrocatalytic activity for reduction of one or more organic compounds comprising one or more functional groups selected from the group consisting of carbonyl carbon-oxygen double bonds, aromatic double bonds, ethylenic carbon-carbon double bonds, acetylenic carbon-carbon triple bonds, hydroxyl carbon-oxygen single bonds, ether carbon-oxygen single bonds, and combinations thereof. In some embodiments, the first metallic mesh 120 and/or the second metallic mesh 140 are free from additional catalytic materials thereon (e.g., free from additional particles such as nano- or micro-scale particles having catalytic activity which otherwise could be deposited on or bound to an outer mesh surface). In other embodiments, at least one of the first metallic mesh 120 and the second metallic mesh 140 includes a further catalytic material thereon (e.g., particles such as nano- or micro-scale particles having catalytic activity; can be deposited on or bound to an outer mesh surface by any suitable known techniques). Such further catalytic materials can be formed from the same or different metal(s) relative to the underlying metallic mesh upon which they are deposited (e.g., catalytic particles including Ru, Ni, Fe, Cu, Pt, Pd, Rh, Ir, Re, Os, Ag, Au, Co, Mo, Ga, Ti, Mn, Zn, V, Cr, W, Sn, mixtures thereof, alloys thereof, and combinations thereof which are the same or different from their underlying metallic mesh, such as catalytic Ru (nano)particles deposited on a Cu—Ni metallic mesh).

Figure 2:
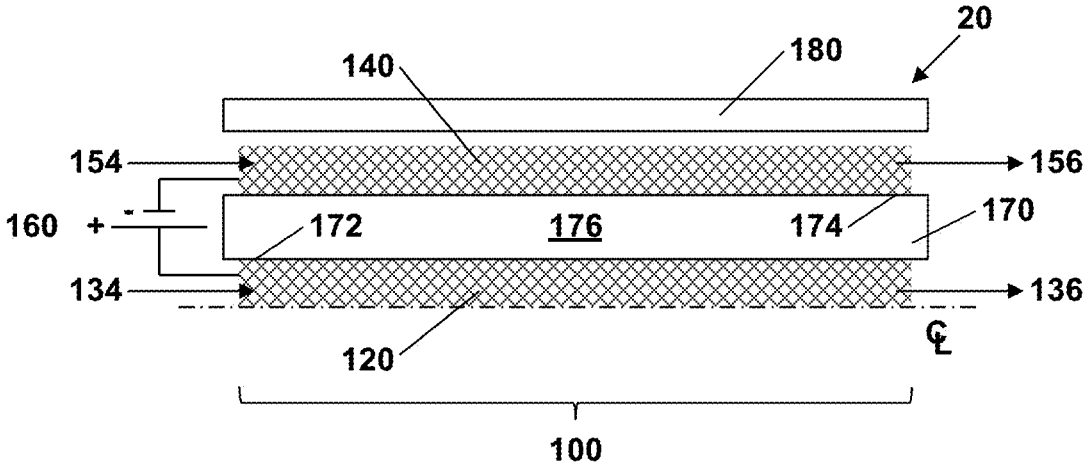
FIG. 2 is a side cross sectional view of an electolyzer reactor according to the disclosure and having a generally tubular geometry for its proton exchange membrane in addition to first and second metallic meshes.
Figure 2A:
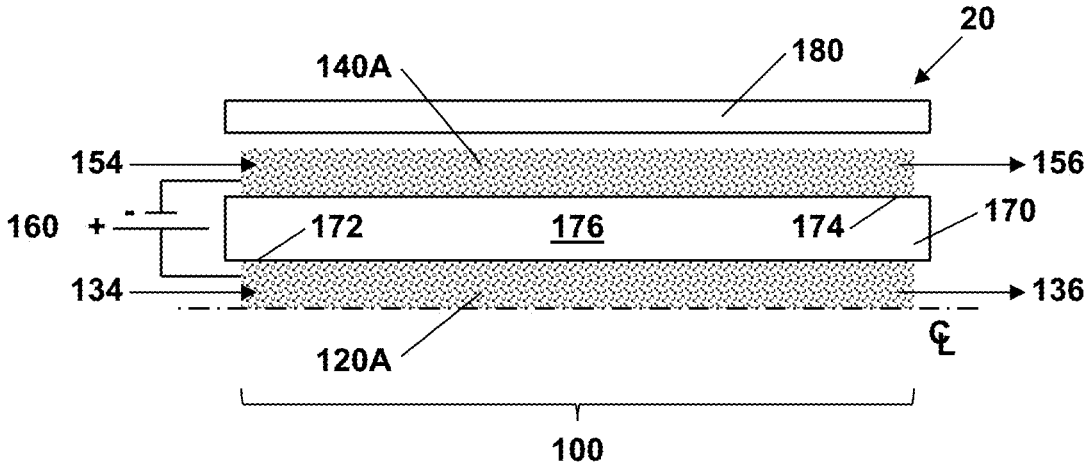
FIG. 2A is a side cross sectional view of an electolyzer reactor according to the disclosure and having a generally tubular geometry for its proton exchange membrane in addition to first and second metallic powder packings.
Figure 2B:
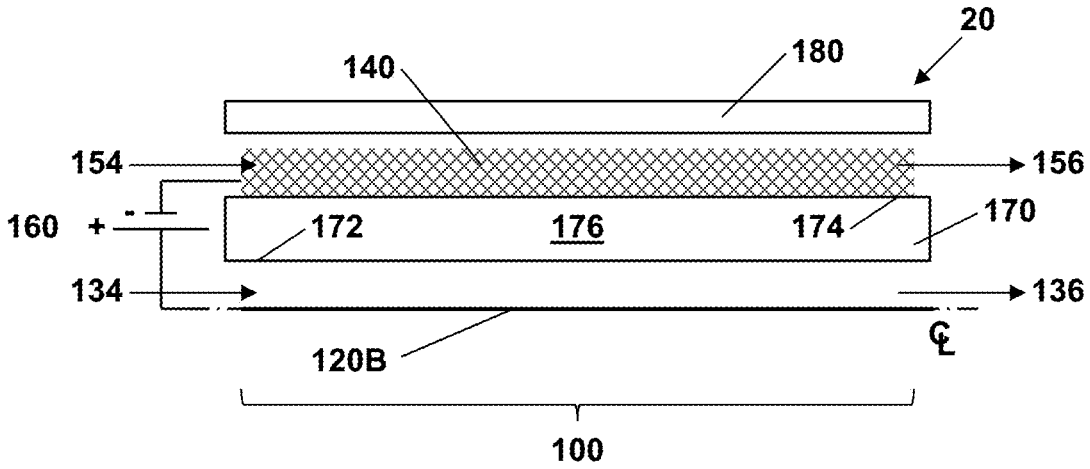
FIG. 2B is a side cross sectional view of an electolyzer reactor according to the disclosure and having a generally tubular geometry for its proton exchange membrane in addition to a metallic mesh and an electrode wire.

The reactor 10 illustrated in FIG. 1 has a generally planar geometry (e.g., corresponding to the generally planar structure of the PEM 110). FIGS. 2, 2A, and 2B illustrate alternative embodiments in which the reactor 10 has a generally tubular geometry. The PEM 110 of FIG. 1 is replaced by a PEM 170 in the form of a tube (e.g., having a circular, oval, square, rectangular, or other cross section; straight and/or curved tube). The PEM 170 tube has a first surface 172 as its interior surface and a second surface 174 as its outer surface. The PEM 170 tube defines the first reaction volume 130 as a tubular volume containing the first metallic mesh 120 therein, and the second reaction volume 150 is defined by an outer shell 180 as an (annular) volume between the outer shell 180 and the PEM 170 tube and containing the second metallic mesh 140 therein (FIG. 2). In some embodiments, the outer shell 180 can be formed from an electrically conductive material (e.g., copper tubing), and the shell 180 provides the electrical path for electrons to the second metallic mesh 140. Water providing the source of protons and electrons suitably flows through the inlet 134 into and through the PEM 170 tube interior in contact with the first metallic mesh 120, while the organic compounds to be reduced flow through the inlet 154 into and through the volume between the outer shell 180 and the PEM 170 tube in contact with the second metallic mesh 140. The tubular geometry is particularly amenable to countercurrent and concurrent flow configurations, and it can provide an increased surface area for reduction on the second mesh 140 at the second surface 174 (e.g., providing more heterogeneous reaction surface area as compared to the first surface 172/first mesh 120). In some alternative embodiments, the first metallic mesh 120 or the second metallic mesh 140 is replaced by free first and second metallic powder packings 120A, 140A (e.g., supported or unsupported catalytic metal particles such as Cu, Ni, or the others as generally described above for the meshes 120, 140 and any additional catalytic materials thereon) in the first reaction volume 130 or the second reaction volume 150, respectively (FIG. 2A). For example, the first and second metallic powder packings 120A, 140A can be unsupported catalytic metal particles such as Ru, Ni, Fe, Cu, Pt, Pd, Rh, Ir, Re, Os, Ag, Au, Co, Mo, Ga, Ti, Mn, Zn, V, Cr, W, Sn, mixtures thereof, alloys thereof, and combinations thereof. Alternatively or additionally, the first and second metallic powder packings 120A, 140A can be supported catalytic metal particles such as Ru, Ni, Fe, Cu, Pt, Pd, Rh, Ir, Re, Os, Ag, Au, Co, Mo, Ga, Ti, Mn, Zn, V, Cr, W, Sn, mixtures thereof, alloys thereof, and combinations thereof, for example catalytic metal particles supported on electrically conductive substrates such as carbon substrates (e.g., activated carbon). In some alternative embodiments, the first metallic mesh 120 can be omitted and replaced with an electrode wire 120B (e.g., a Pt wire) capable of water oxidation and electron production, for example where the electrode wire is spaced apart from and generally not in contact with the PEM 170 tube (FIG. 2B; illustrated with the metallic mesh 140, but which could alternatively include the second metallic powder packing 140A).

Reduction of Organic Compounds

The electrolyzer reactor 10 in any of its various embodiments can be used in a corresponding process for reducing organic compounds (e.g., upgrading fast pyrolysis bio-oil or components thereof). Application of a voltage potential across the first and second metallic meshes 120, 140 drives electrons formed at the first metallic mesh to the second metallic mesh for organic compound reduction. Water supplied to the first reaction volume 130 (e.g., via inlet 134) is oxidized at the surface of the first metallic mesh 120 (e.g., as the anode), thereby generating hydrogen ions (protons), electrons, and oxygen gas. The hydrogen ions are transported through the PEM 110 (in a direction from the first surface 112 to the second surface 114). The electrons are transported to the second metallic mesh 140 via the external electrical circuit and provide the electrons for heterogeneous organic compound reduction at the second metallic mesh 140. The oxygen gas can exit the first reaction volume 120 via the outlet 136 along with unreacted water. The water supplied to the first reaction volume 130 can further include one or more electrolytes, for example a pH buffer (e.g., phosphate buffer components providing a non-proton cation species such as potassium in a potassium phosphate buffer that is capable of trans-membrane transport), a soluble salt of a metal (e.g., a metal which is a component of the first metallic mesh 120 and/or of the second metallic mesh 140, such as nickel or other catalytic metal usable in the mesh material itself; the metal salt similarly providing a non-proton cation species that is capable of trans-membrane transport). Reducible organic compounds (e.g., a plurality of different organic reactants to be reduced, for example via ECH/ECHDO) supplied to the second reaction volume 150 (e.g., via the inlet 152, suitably in combination with water) are reduced at the second metallic mesh 140 (e.g., as the cathode) to form corresponding reduced organic compound reaction products. The reactant mixture (e.g., including the reducible organic compounds and water) and the second reaction volume 150 suitably are free from added electrolytes and/or added organic solvents. The reaction products can exit the second reaction volume 140 via the outlet 156 along with any generated hydrogen gas. The reduced organic compound reaction product can be recovered or separated from the second reaction volume (e.g., from the outlet stream 156 from the reactor/second reaction volume 150).

Figure 11:
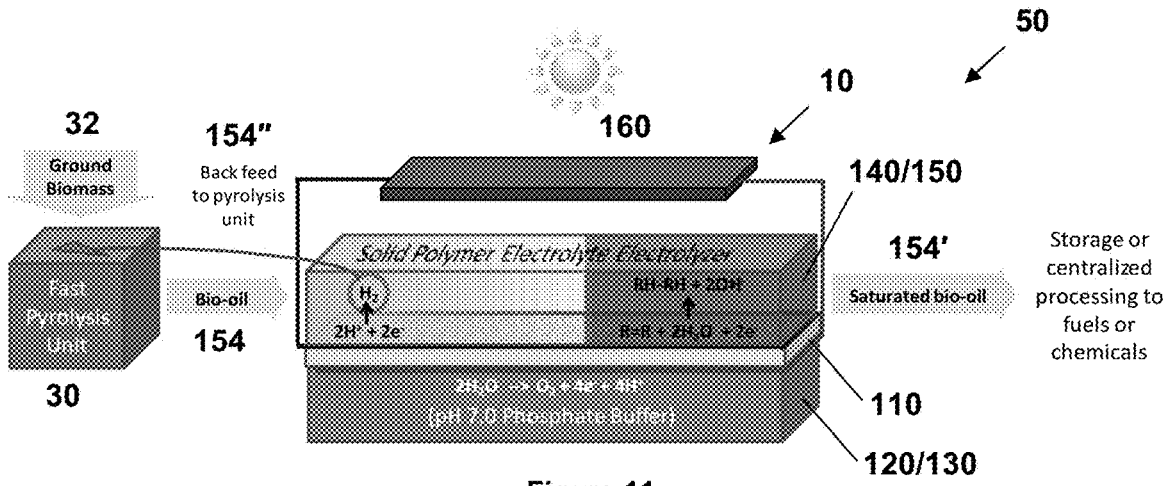
FIG. 11 is a schematic illustrating an electrolyzer reaction system according to the disclosure including an electrolyzer reactor coupled to a fast pyrolysis unit for forming bio-oil, which can be upgraded immediately upon exit from the electrolyzer reactor.

In some embodiments, the method further includes recovering or separating the hydrogen gas generated during organic compound reduction from the second reaction volume 150 and feeding the hydrogen gas to a biomass fast pyrolysis reactor 30, for example as illustrated in FIG. 11 in an electrolyzer system 50. As illustrated, hydrogen gas recovered from an outlet stream 156" from the reactor 10 and/or directly from the second reaction volume 150 is fed to the pyrolysis reactor 30 along with (ground) biomass 32. The bio-oil (or component or fraction thereof) exiting the pyrolysis reactor 30 is fed to the electrolyzer reactor 10 via the inlet 154 as at least a portion of the organic compound reactant mixture for reduction. The upgraded (reduced) bio-oil product is recovered from the electrolyzer reactor 10 via an outlet stream 156'.

The disclosed processes are applicable to a broad range of organic reactants/substrates as the reducible organic compound. In various embodiments, the second metallic mesh having catalytic activity is capable of catalyzing reduction reactions such as at least one of (i) ECH of unsaturated carbon-carbon bonds in an organic substrate (e.g., ethylenic or acetylenic functionalities), (ii) ECH of carbon-oxygen double bonds in an organic substrate, and/or (iii) ECHDO of carbon-oxygen single bonds in an organic substrate. For example, the carbonyl carbon-oxygen double bonds subject to ECH/ECHDO can be present in a functional group selected from the group consisting of ketone groups, aldehyde groups, carboxylic acid groups, ester groups, amide groups, enone groups, acyl halide groups, acid anhydride groups, and combinations thereof. The aromatic double bonds subject to ECH/ECHDO can be carbon-carbon aromatic double bonds or carbon-heteroatom double bonds (e.g., such as C with N, O, or S in a heteroaromatic functional group). Such aromatic double bonds can be present in a functional group selected from the group consisting of benzenes, phenols, furans, pyridines, pyrazines, imidazoles, pyrazoles, oxazoles, thiophenes, naphthalenes, higher fused aromatics (e.g., with three or more fused aromatic rings), and combinations thereof. In such cases, the functional group can be the compound itself (such as phenol being reduced to cyclohexanone) or a substituted derivative of the compound (such as guaiacol being reduced to phenol).

As an example of a specific functional group amenable to electrocatalytic treatment and reduction in the electrolyzer reactor, the functional group can comprise a C═O group, and the corresponding ECH reaction product can comprise at least one of a C—OH group (e.g., a CH—OH group) and a $CH_2$ group (e.g., for ECH followed by ECHDO of the intermediate hydroxy group). In another embodiment, the functional group can comprise an aromatic CH group, and the corresponding ECH reaction product can comprise a $CH_2$ group (e.g., in a reduced cyclic reaction product). In another embodiment, the functional group can comprise an ethylenic C═C group, and the corresponding ECH reaction product can comprise a CH—CH group. In another embodiment, the functional group can comprise a C—OH group, and the corresponding ECHDO reaction product can comprise a CH group (e.g., a deoxygenated alcohol/hydroxyl group). In another embodiment, the functional group can comprise a C—OR group, and the corresponding ECHDO reaction product can comprise a CH group (e.g., a deoxygenated alkoxy group where R is an alkyl group (such as with 1 to 10 carbon atoms); including ROH as an additional alcohol reaction product). In another embodiment, the functional group can comprise a (C═O)O group, and the corresponding ECHDO reaction product can comprise at least one of a (C═O)H group and a C—OH group (e.g., a carboxylate group (such as in a carboxylic acid) which is deoxygenated or reduced to form a corresponding aldehyde and/or alcohol, for example including a —$CH_2OH$ group); such as may take place at reaction temperatures above about 70° C.). In another embodiment, the functional group can comprise an ether $R_1$—O—$R_2$ group, and the corresponding ECH or ECHDO reaction products can comprise one or more of a $R_1H$, $R_2OH$, $R_1OH$, and $R_2H$, where $R_1$ and $R_2$ are organic or hydrocarbon substituents, for example containing from 1 to 10 carbon atoms (e.g., $R_1$ and $R_2$ can be organic or hydrocarbon substituents having at least 1, 2, or 3 carbon atoms and/or up to 6, 8, or 10 carbon atoms, which can include one or more heteroatoms (e.g., N, O, S) as well as the various carbonyl (ketone, aldehyde, ester, etc.), hydroxyl, aromatic, and ethylenic groups mentioned above).

In a particular refinement, (i) the functional group comprises an ether $R_1$—O—$R_2$ group, (ii) the corresponding ECH or ECHDO reaction products comprise one or more of a $R_1H$, $R_2OH$, $R_1OH$, and $R_2H$, (iii) $R_1$ is a substituted or unsubstituted aromatic or heteroaromatic substituent containing 3 to 20 carbon atoms (e.g., $R_1$ can have at least 3, 4, 5, or 6 and/or up to 6, 8, 10, 15, or 20 carbon atoms, which can include one or more heteroatoms (e.g., N, O, S) as well as the various carbonyl (ketone, aldehyde, ester, etc.), hydroxyl, aromatic, and ethylenic groups mentioned above), and (iv) $R_2$ is a substituted or unsubstituted alkyl substituent containing from 1 to 10 carbon atoms (e.g., $R_2$ can be organic or hydrocarbon substituents having at least 1, 2, or 3 carbon atoms and/or up to 6, 8, or 10 carbon atoms, which can include one or more heteroatoms (e.g., N, O, S) as well as the various carbonyl (ketone, aldehyde, ester, etc.), hydroxyl, aromatic, and ethylenic groups mentioned above).

In another refinement, (i) the functional group comprises an ether $R_1$—O—$R_2$ group, (ii) the corresponding ECH or ECHDO reaction products comprise one or more of $R_1$*H and $R_2OH$, (iii) $R_1$ is a substituted or unsubstituted aromatic or heteroaromatic substituent containing 3 to 20 carbon atoms, (iv) $R_1$* is a hydrogenated analog of $R_1$, and (v) $R_2$ is a substituted or unsubstituted alkyl substituent containing from 1 to 10 carbon atoms. R.sub.1 and $R_2$ can have the same refinements as noted above (e.g., related to the number of carbon atoms, presence and nature of heteroatoms, etc.).

$R_1$*, as the hydrogenated analog of $R_1$, can be a substituted or unsubstituted cycloalkyl or cycloheteroalkyl substituent containing 3 to 20 carbon atoms (e.g., as similarly refined above with respect to $R_1$) which is completely saturated/hydrogenated relative to $R_1$. For example, when $R_1$ is a 2-substituted phenol such as in 2-methoxyphenol (guaiacol), then $R_1$*H is cyclohexanol (i.e., where both the aromatic phenolic ring and the cleaved methoxy bond have been hydrogenated). In the event of partial/incomplete saturation relative to $R_1$, $R_1$* can include corresponding cycloalkenyl or cycloheteroalkenyl analogs of $R_1$.

In various embodiments, the initial reaction mixture as fed to the second reaction volume can comprise a plurality of different reducible organic compound reactants each comprising one or more of the functional groups, and the final reduced reaction mixture can comprise a plurality of corresponding ECH reaction products and/or ECHDO reaction products. In a refinement, the reaction mixture can comprise a plurality of the organic reactants, the plurality being selected from the group consisting of a multicomponent lignin depolymerization product, a multicomponent lignin depolymerization product fraction, a plurality of lignin depolymerization product components, and combinations thereof. The lignin depolymerization product can represent a multicomponent mixture of phenolic, methoxylated monomers and oligomers (e.g., with 2-10 phenolic residues) resulting from the treatment of lignin-containing biomass (e.g., ammonia-fiber expansion (AFEX)-lignin; black/brown liquor streams).

In another refinement, the initial reaction mixture as fed to the second reaction volume can comprise a plurality of the reducible organic compound reactants, the plurality being selected from the group consisting of a multicomponent bio-oil, a multicomponent bio-oil fraction, a plurality of bio-oil components, and combinations thereof (e.g., a reaction product produced from the fast pyrolysis of (lignocellulosic) biomass or a fraction/subset of the components thereof). In an embodiment, the pyrolytic process is performed in the same facility as the organic reduction (e.g., ECH/ECHDO) treatment. In another embodiment, the bio-oil from the pyrolytic process is subjected to the organic reduction treatment within 1 hr, 2 hr, 4 hr, 8 hr, or 24 hr from formation of the bio-oil (for example to permit fractionation or other intermediate processing before organic reduction treatment). In one refinement, the reaction mixture is free from added solvents (e.g., the organic reduction treatment is performed on the bio-oil (or more generally other organic reactants) without solvents, such as where the organic reactant(s) is initially at least about 90%, 95%, 98%, or 99% by weight of the reaction mixture (e.g., where the organic reactant amount can include the natural water content of bio-oil). In a further refinement, the reaction mixture can comprise the multicomponent bio-oil fraction, the fraction having been obtained by extraction of bio-oil using a solvent comprising one or more of water, methanol, ethanol, diethyl ether, ethyl acetate, dichloromethane, chloroform, toluene, and hexane (e.g., thus providing a water-soluble or other specific solvent-soluble bio-oil fraction, etc.). In another refinement, the reaction mixture comprises one or more of water and a water-miscible organic solvent (e.g., methanol, ethanol, 1-propanol, 2-propanol, 1-butanol, tetrahydrofuran, and mixtures thereof). In an embodiment, the reaction mixture is free from added electrolytes and/or organic solvents (e.g., water-miscible, water-immiscible, or otherwise). In an embodiment, the reaction mixture comprises water and the water is present in an amount of at least 10 wt. %, 12 wt. %, 15 wt. %, 20 wt. %, 25 wt. %, or 30 wt. % and/or up to 20 wt. %, 30 wt. %, 40 wt. %, 50 wt. %, 70 wt. %, 90 wt. %, or 95 wt. % relative to the reaction mixture (with similar concentrations being applicable for the organic reactants individually or collectively in the reaction mixture). In various embodiments, the reaction mixture comprises one or more reactants selected from the group consisting of acetol, hydroxyacetaldehyde, glyoxal, formaldehyde, acetic acid, phenol, guaiacol, syringol, levoglucosan, furfural, glucose, xylose, substituted derivatives thereof, and combinations thereof (e.g., a plurality of bio-oil pyrolysis products as reactants or derived from another source). Similarly, the reaction product comprises one or more of ethylene glycol, propylene glycol, cyclohexanol, furfuryl alcohol, and methanol (e.g., resulting from a bio-oil or other organic reactant feed stream).

Biomass pyrolysis derived bio-oil (or pyrolysis oil) is a mixture containing hundreds of organic compounds with chemical functionalities that are corrosive to container materials and are prone to polymerization. Bio-oil is a condensed liquid oxygenated hydrocarbon product of the fast pyrolysis of biomass (e.g., agricultural biomass, forest biomass). Biomass pyrolysis includes heating to moderate temperatures (e.g., 450° C. to 650° C., without oxygen), and vapors formed during pyrolysis are condensed to provide a liquid bio-oil as a complex mixture of various compounds derived from the lignocellulosic precursors in the biomass. The specific composition of a particular bio-oil depends on its particular biomass feedstock, but representative components include water (e.g., 15-40 wt. %), pyrolitic lignin (e.g., 15-40 wt. %, including guaiacols, catechols, syringols, vanillins, etc.), carboxylic acids (e.g., 3-10 wt. % acetic acid, 2-8 wt. % formic acid), aldehydes and ketones (e.g., 5-15 wt. % glycolaldehyde; 2-8 wt. % acetol; 0.5-5 wt. % glyoxal; 1-6 wt. % formaldehyde, 2-8 wt. % acetaldehyde), and various carbohydrate pyrolysis derivatives (e.g., glucose, xylose, levoglucosan).

Bio-oil as obtained is generally a viscous, acidic brown oil (e.g., having a pH value of about 1-3). Suitable biomass sources for bio-oil formation include plants, trees (e.g., pine trees), agricultural crops, crop residues, grasses, forest and mill residues, wood and wood waste (e.g., saw dust), paper mill waste, and/or waste paper. Representative biomass constituents include cellulose, lignin, hemicellulose, fatty acids, and/or triglycerides, with particular components and amounts varying based on the source of the biomass. As described herein, bio-oil can be separated into a water-soluble fraction and a water-insoluble fraction by an aqueous extraction process for further processing by organic compound reduction (e.g., ECH/ECHDO) of a subset of the original bio-oil constituents. Similarly, when a different solvent/extraction medium is used (e.g., non-aqueous solvent(s) alone or in combination with water as a solvent mixture), the bio-oil can be separated into a solvent-soluble fraction and a solvent-insoluble fraction for subsequent processing.

As noted, bio-oil as originally obtained from pyrolysis is a complex mixture of many different organic compounds having various chemical functionalities. Examples of specific reactant compounds include one or more of formaldehyde, acetaldehyde, glycolaldehyde, propanal, butanal, butanedial, acetone, 2,3-butanedione, formic acid, acetic acid, methyl acetate, propanoic acid, acetol, 1-hydroxy-2-butanone, furfural, furfuryl alcohol, 2-furanone, cyclopentanone, 3-methyl-2-cyclopentenone, 3-methyl-1,2-cyclopentanedione, levoglucosan, glucose, xylose, phenol, 2-methylphenol (cresols more generally), guaiacol, 4-ethylguaiacol, eugenol, isoeugenol, methoxyeugenol, syringol, and trimethoxybenzene (1,2,3- and other isomers). More generally, representative bio-oil constituents (or organic reactants from a different feedstock) can include linear, cyclic, or branched hydrocarbons and heteroatom-substituted hydrocarbons having at least 1, 2, or 3 carbon atoms and/or up to 6, 8, 10, 15, or 20 carbon atoms, for example having the various noted oxygen-containing and unsaturated/aromatic functional groups amenable to reduction by ECH/ECHDO according the disclosure. In some embodiments, higher molecular weight constituents may be present in the bio-oil, for example representing constituents from the original lignocellulosic biomass, incomplete pyrolysis products therefrom, and/or subsequent oligomerization/polymerization products from the low molecular weight pyrolysis bio-oil constituents.

Reaction products resulting from the ECH/ECHDO of bio-oil, fractions thereof, or components thereof generally correspond to the reduced/hydrogenated and/or deoxygenated forms of their respective reactants. Examples of specific product compounds include one or more of ethanol, 1-propanol, 2-propanol, 1-butanol, tetrahydrofurfuryl alcohol, cyclopentanol, cyclohexanol, ethylene glycol, propylene glycol, 1,2-butanediol, 1,4-butanediol, and sorbitol. More generally, representative ECH/ECHDO reduction reaction products (from bio-oil constituents or organic reactants from a different feedstock) can include linear, cyclic, or branched hydrocarbons and heteroatom-substituted hydrocarbons having at least 1, 2, or 3 carbon atoms and/or up to 6, 8, 10, 15, or 20 carbon atoms, for example including linear, cyclic, or branched alcohols, diols, polyols, saturated alkanes, and saturated heteroatom-substituted alkanes.

Before reduction via electrocatalytic hydrogenation and/or hydrodeoxygenation, bio-oil (or other organic reactants more generally) can be pretreated to increase its conductivity. In some embodiments, bio-oil pretreatment includes, but is not limited to, 1) electrolytes are added into the bio-oil directly; 2) bio-oil is dissolved in a solvent, such as mixture of methanol and water, and electrolytes are added into the bio-oil and solvent mixture; or 3) separation/extraction of bio-oil using water (or other solvent) is performed to form a water-soluble fraction and a water-insoluble fraction, and electrolytes are added into the water-soluble fraction to perform electrocatalytic hydrogenation. In other embodiments, bio-oil pretreatment includes separation, extraction, and/or dissolution of bio-oil with one or more of water, a water-miscible organic solvent, and a water-immiscible organic solvent, but without the addition of an added electrolyte.

The disclosed process is illustrated and described in the context of the electrocatalytic hydrogenation and/or hydrodeoxygenation of bio-oil, but it is not limited to bio-oil. Other organic compounds with unsaturated and/or oxygen-containing carbon bonds or organic compound mixtures containing such functional groups can also be reduced/hydrogenated or deoxygenated using the disclosed methods and compositions. In addition to bio-oil, an example of another bio-based feedstock with organic compounds suitable for ECH/ECHDO treatment includes lignin depolymerization products (e.g., multicomponent mixtures thereof, fractions thereof, etc.) with one or more phenolic, methoxylated monomers and related oligomers (e.g., with 2-10 phenolic residues) resulting from the treatment of lignin-containing biomass (e.g., ammonia-fiber expansion (AFEX)-lignin; black/brown liquor streams).

The reduction reaction processes can be performed in the electrolyzer reactor with a variety of operating conditions. While the reduction (e.g., ECH/ECHDO) reactions are suitably performed under mild/ambient conditions (e.g., 0° C. to 100° C. and 0.8 atm to 1.2 atm), the operating conditions can be extended to other temperature and/or pressure values. For example, the reduction reaction can be performed as a batch or a continuous process. In various embodiments, the reduction reaction is performed at a temperature of at least 0° C., 20° C., 25° C., 30° C., 50° C., or 70° C. and/or up to 30° C., 50° C., or 70° C., 80° C., 90° C., 100° C., 150° C., 200° C., 250° C. or 300° C. (e.g., below the boiling point of the reaction medium/solvent system therefor, including pressurized reaction vessels permitting elevated temperatures above the normal (atmospheric pressure) boiling point, such as a water reaction medium at an appropriate elevated pressure permitting reaction temperatures above 100° C.). The reduction reaction can be performed at a pressure of at least 0.5 atm, 0.8 atm, or 1 atm and/or up to 1.2 atm, 1.5 atm, 2 atm, 5 atm, 10 atm, 20 atm, 40 atm, or 50 atm. The reduction reaction can be performed at a current density of at least 10 $mA/dm^2$, 50 $mA/dm^2$, 100 $mA/dm^2$, 200 $mA/dm^2$, or 500 $mA/dm^2$ and/or up to 100 $mA/dm^2$, 200 $mA/dm^2$, 500 $mA/dm^2$, 1000 $mA/dm^2$, 2000 $mA/dm^2$, 5000 $mA/dm^2$, or 10000 $mA/dm^2$. The reducible organic compound reactant can have a concentration in the initial reaction mixture of at least 1 mM, 2 mM, 5 mM, 10 mM, 20 mM, 50 mM, or 100 mM and/or up to 50 mM, 100 mM, 200 mM, 500 mM, 1,000 mM, 5,000 mM or 10,000 mM (e.g., as the concentration of a single organic reactant or as the total concentration of multiple organic reactants in the initial reaction mixture). In some embodiments, the reaction mixture can be free from added solvents (e.g., the reaction medium is composed essentially entirely of one or more organic reactants, with optional ingredients such as pH agents, surfactants, etc.; such as where the organic reactant(s) is initially at least about 90%, 95%, 98%, or 99% by weight of the reaction mixture). In other embodiments, the reaction mixture can further comprise a solvent system for the organic reactant (e.g., an aqueous (water) solvent system, an organic solvent system (e.g., a water-miscible or water-immiscible system), or a combination thereof; suitably selected to solvate reactants and products). For example, the solvent system can comprise water and/or one or more water-miscible organic solvents (e.g., to provide an aqueous medium as the reaction mixture). Suitable water-miscible solvents can include methanol, ethanol, 1-propanol, 1-butanol, tetrahydrofuran, and mixtures thereof.

Other description related to suitable reactants, products, and operating conditions for organic compound reduction via ECH/ECHDO mechanisms may be found in Saffron et al. International Publication No. WO 2013/134220 and Jackson et al. U.S. Publication No. 2014/0110268, both of which are incorporated herein by reference in their entireties.

EXAMPLES

The following examples illustrate the disclosed apparatus, compositions, and methods, but are not intended to limit the scope of any claims thereto.

Example 1

Example 1 illustrates the operation of an electrolyzer as generally illustrated in FIG. 1 for the reduction of acetol (i.e., as a model bio-oil reducible organic compound) to propylene glycol. Different metallic meshes and reaction conditions were evaluated for catalytic activity and current efficiency, which provides an indication of the effectiveness of the system in catalyzing hydrogenation.

Experimental

Copper meshes (mesh #200) and stainless steel 314 meshes (mesh #200) were selected as the metallic mesh/electrode materials and were cut to in the dimensions of 2.3×2.3 cm and were stored in hexane until use. The cathode solution was 10 mL of 5% acetol with 5% acetic acid in water and the anode solution was a reservoir of 200 mL of 0.1 M pH 7.0 phosphate buffer solution. Reduction reactions were run at room temperature. The components of the electrolyzer were assembled in the following order (e.g., from left to right as illustrated in FIG. 1): anode compartment, silicon gasket, anode mesh, silicon gasket, NAFION PEM membrane, cathode mesh, silicon gasket, cathode compartment.

Cathode solution was circulated by a peristaltic pump at 0.8 ml $min^{-1}$. 0.25 mL of sample was taken hourly from the reservoir, and was diluted with equal amounts of deionized water before HPLC-RI analysis (isocratic flow at 0.5 mL $ml^{-1}$; 5 mM of sulfuric acid; room temperature; column: AMINEX HPX-87H, Waters 410 RI detector setting: internal temperature 35° C., sensitivity: 128).

The catalytic effects of three different metals: copper, nickel and stainless steel (SS) were compared as shown in Table 1. In the absence of acetic acid, the reaction rate decreased in the following order Cu>Ni>>SS. Stainless Steel showed relatively low catalytic activity towards acetol hydrogenation, but the situation changed when it was plated with nickel in a Watts plating bath ($H_3BO_3$ 30 g/L, $NiCl_2.6H_2O$ 45 g/L, $NiSO_4.6H_2O$ 300 g/L) at 100 mA for 5 minutes. This nickel plating confirmed that the current collector mesh was the reaction surface. Copper had the highest current efficiency of the three metals, and it also had the greatest material balance relative to the other two electrolysis trials. However, it must be noted that the mass balance of all the trials was particularly low at about 35.8-55.4%. Based on the control experiment using stainless steel, approximately 5% of the material loss was due to membrane crossover. The remaining losses were likely to be associated with the high pH of the cathode solution after 6 hours of electrolysis. The cathode solution changed from colorless to yellow, which suggested that the acetol might have gone through aldol condensation in the increasingly basic conditions.

TABLE 1

Acetol Conversion with Metallic Mesh Electrodes

| | Acetol remaining (mM) | Propylene glycol formed (mM) | Current efficiency (%) | Material balance (%) | End pH |
|---|---|---|---|---|---|
| Stainless Steel (Control with no $e^-$ passed) | 876 | 0 | 0 | 94.8 | 6.34 |
| Stainless Steel | 274 | 117 | 10.4 | 42.3 | 11.23 |
| Nickel plated on Stainless Steel | 12 | 319 | 28.4 | 35.8 | 12.28 |
| Copper | 114 | 398 | 32.9 | 55.4 | 10.88 |
| Copper with 5% Acetic Acid* | 335 | 152 | 13.8 | 68.0 | 5.23 |

TABLE 1-continued

Acetol Conversion with Metallic Mesh Electrodes

Notes:

10 ml of 5% acetol (924.5 mM) dissolved in deionized water undergo ECH to propylene glycol after 6 hours at a constant current 98 ± 2 mA, at room temperature and ambient pressure. All current collectors are mesh 200 in size, and had been cleaned with hexane, acetone and water prior to use. Stainless steel 304 (Mesh 200) was used in a 0.1M pH 7.0 phosphate buffer as an anode for all trials. Material balance was calculated by summing acetol and propylene glycol alone.

*Initial acetol concentration for the "copper with 5% acetic acid" trial was 716 mM.

To verify whether acetol condensed in the basic environment, 0.1 mL of 1 M NaOH was added to the 10 ml 5% acetol solution and was left overnight at room temperature without electrolysis. The mixture turned a mild yellow color that resembled the color of the cathode solution after ECH. The sample was then analyzed by liquid phase MS (Note: no chromatography involved). Higher molecular weight compounds (presumably oligomers) were detected from the control experiment and confirmed that acetol did condense in the basic environment. The higher final pH from the nickel plated mesh trial suggested that nickel favored water reduction (Scheme 1, equation d) forming hydroxyl anion. Paired with the potassium ion diffusing from the anode chamber through the membrane into the cathodic chamber, it is clear that the pH increased as the reaction proceeded.

Figure 3:
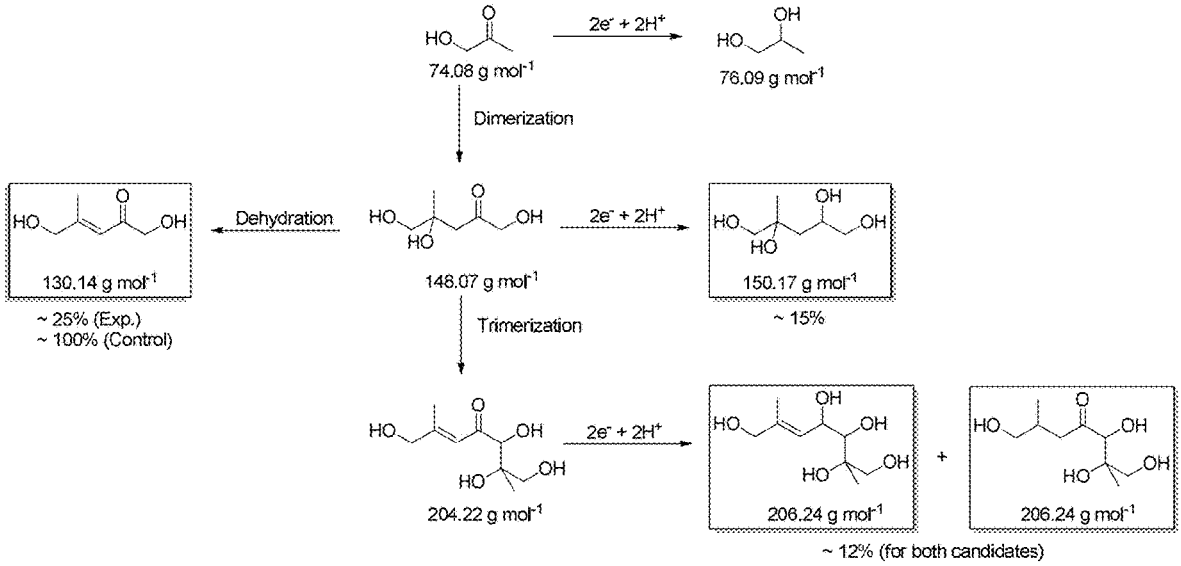
FIG. 3 is a schematic illustrating possible reaction pathways of acetol based on the observed molecular weight from aqueous phase mass spectral analysis, with percentages of the compounds based on the relative intensity of relevant mass spectral peaks.

Scheme 1. Possible cathodic reactions: a) Hydrogen evolution b) acetol undergoes ECH to propylene glycol using electrons and protons c) acetol undergoes ECH to propylene glycol using water and electron as a reductant. d) cathodic water reduction forming hydroxide anion.

a) $2H^+ + 2e^- \text{---} > H_2$ b) $\text{Acetol} + 2e^- + 2H^+ \text{---} > \text{Propylene Glycol}$ c) $\text{Acetol} + 2H_2O + 2e^- \text{---} > \text{Propylene Glycol} + 2OH^-$ d) $H_2O + 2e^- \text{---} > 2OH^- + H_2$ Although the condensation can lead to the formation of molecules with a greater carbon number, a feature which is preferred for fuel purposes (typical carbon number of gasoline ranged from $C_5$-$C_8$, whereas the majority of bio-oil molecules typically range from $C_2$-$C_6$), uncontrollable condensation is undesirable, especially in real bio-oil where hundreds of organics are present leading to formation of unusable tar. It is desirable to maximize the utilization and minimize losses of carbon during the upgrading process. Based on the molecular weight information gathered from direct MS analysis of the solution, the possible reaction pathways and products are shown in FIG. 3 for the ECH experiments.

ECH of Acetol in the Presence of Acetic Acid.

Seeing that aldol condensations led to material loss, 5% (v/v) of acetic acid was added to the acetol cathodic solution. Addition of 5% acetic acid served two purposes a) to mimic the acidic nature of bio-oil, and b) to verify whether the acidic environment could improve mass balance. A control experiment analyzed by HPLC-RI showed acetol did not undergo polymerization in the presence of 5% acetic acid over 15 hours at room temperature, and the acetol stock solution showed no signs of changes after months of storage.

When 5% (v/v) acetic acid was added, the current efficiency for propylene glycol formation dropped by almost 20% (Table 1, without acetic acid 32.9% vs. with acetic acid 13.8%), because the greater $H^+$ concentration favors $H_2$ formation rather than acetol hydrogenation. Formation of $H_2$ occurred at the expense of $H^+$ from acetic acid, so the average pH after 6 hours of electrolysis increased from 2.89 to 5.23. On the other hand, the mass balance also improved 12.6% (without acetic acid 55.4% vs. with acetic acid 68%), which is significant but still incomplete. HPLC-RI analysis showed no side products or polymerized products formed in the reaction, and the 30% loss of material could reflect membrane crossover.

Figure 4:
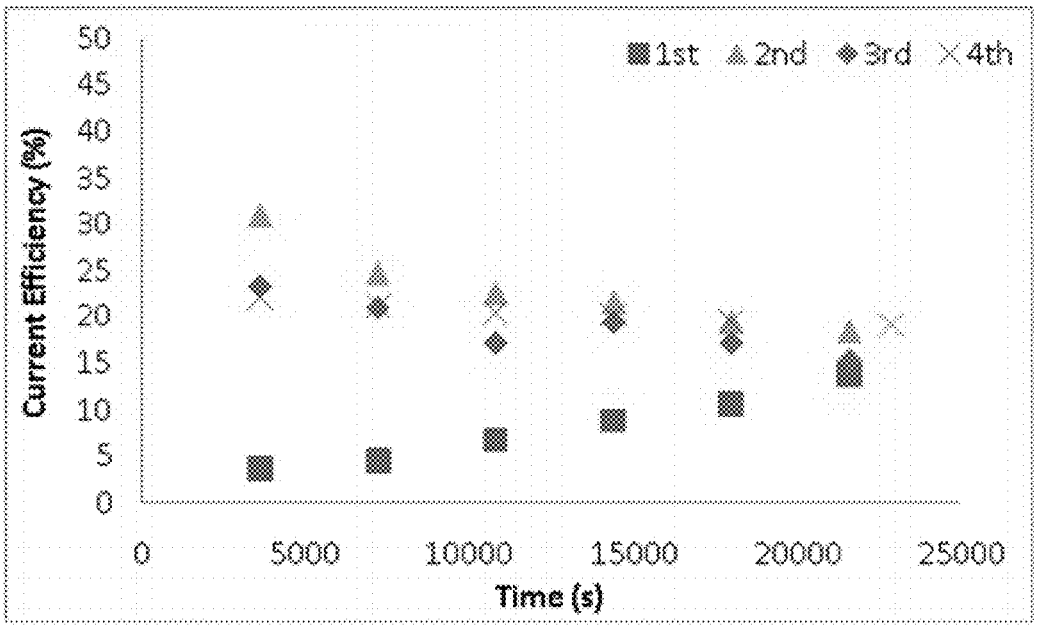
FIG. 4 is a graph illustrating the current efficiency for ECH of 10 ml of 5% acetol with 5% (v/v) glacial acetic acid added. Condition: copper mesh 200 catalytic surface at 98±2 mA at 1 atm at room temperature (22±1° C.) for 6 hours. Copper mesh is being reused multiple times and compared with the MONEL 400 mesh 200, and the reaction is evaluated using the cumulative current efficiency, where each point accounts for the product accumulated previously.
Figure 5:
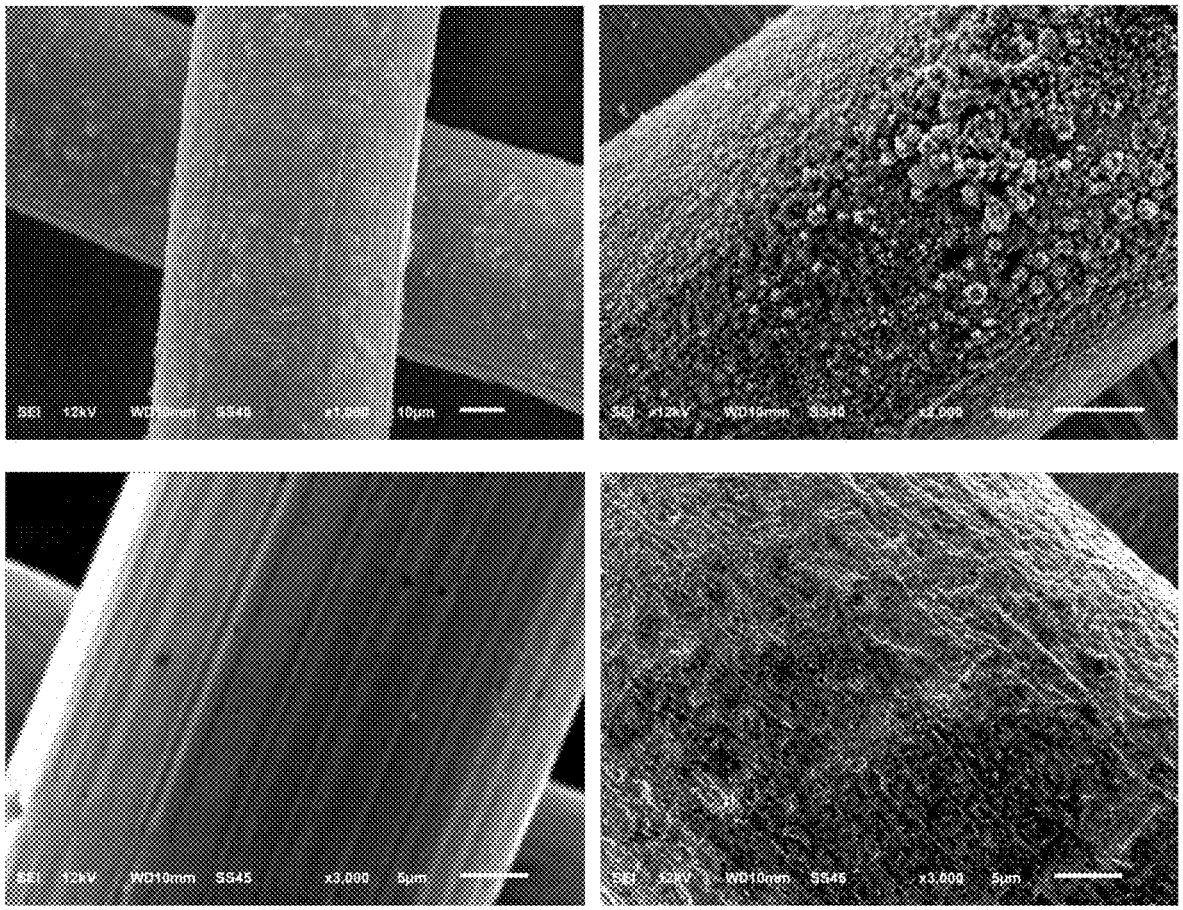
FIG. 5 includes scanning electron microscope (SEM) photographs showing copper mesh before (Top, Left) and after (Top, Right) 6 hours of electrolysis as well as new stainless steel (Bottom, Left) and used stainless steel (Bottom, right). Samples were washed with water, acetone and chloroform to remove organic residues. Then they were dried in vacuum desiccator for 2 hours before SEM examination at 12 kV and 10 mm working distance under ultrahigh vacuum.

When the copper mesh was used multiple times for the same reaction as the cathode, the current efficiency trend changed significantly (FIG. 4, where the legend indicated the number of times the copper mesh was used). The current efficiency of new copper mesh ("1st" in FIG. 4) started low at approximately 3.7% and rose to 13.8% whereas the used copper mesh ("2nd", "3rd", and "4th" in FIG. 4) started at about 30%, and then dropped slowly during the course of reaction. The trend suggested that perhaps the copper was being activated during its 1st use. Upon disassembly of the reaction cell, a black layer was found on the surface of the copper. Examination under SEM with EDX analysis revealed the black layer resulted from morphological changes on the cathode surface. As shown in FIG. 5, nickel and copper were detected (EDX analysis: 55% Ni and 30% Cu) with minor carbon and oxygen impurities. The nickel likely originated from the stainless steel anode mesh that was slowly undergoing anodic oxidation; this notion was confirmed by the SEM images of the used stainless steel mesh in FIG. 5 (bottom left). Knowing stainless steel contains 8-10% nickel, and seeing the SEM observation of the surface erosion of the stainless steel, it is reasonable to conclude that the nickel deposition originated from the stainless steel anode. Nickel ions ($Ni^{2+}$) travelling through the membrane and re-deposited on the copper mesh formed a catalytically active nickel-copper surface favoring organic hydrogenation. The rough nickel-copper surface as seen in FIG. 5 (top right) has an increased the surface area, thereby improving the ECH rate. Interestingly, even though the stainless steel anode mesh was undergoing oxidation, it lasted for 30 hours (i.e., 5 trials of 6 hours each) of electrolysis without obvious macroscopic signs of degradation.

Example 2

Given the improvement in current efficiency enabled by the nickel re-deposition, Example 2 illustrates an electrolyzer reaction with a stainless steel mesh (mesh size 200) anode as in Example 1, but with a nickel-copper alloy mesh cathode for improved catalytic hydrogenation activity (i.e., the mesh material as originally manufactured included nickel, notwithstanding the possible re-deposition of nickel from the stainless steel during reactor operation). Hence, MONEL 400, a commercially available nickel-copper alloy mesh (at least about 63% Ni, about 28-34% Cu, about 2.5% Fe, and about 2% Mn, by weight) having a mesh size of 200 was selected as a cathodic catalytic material for acetol hydrogenation.

Figure 6:
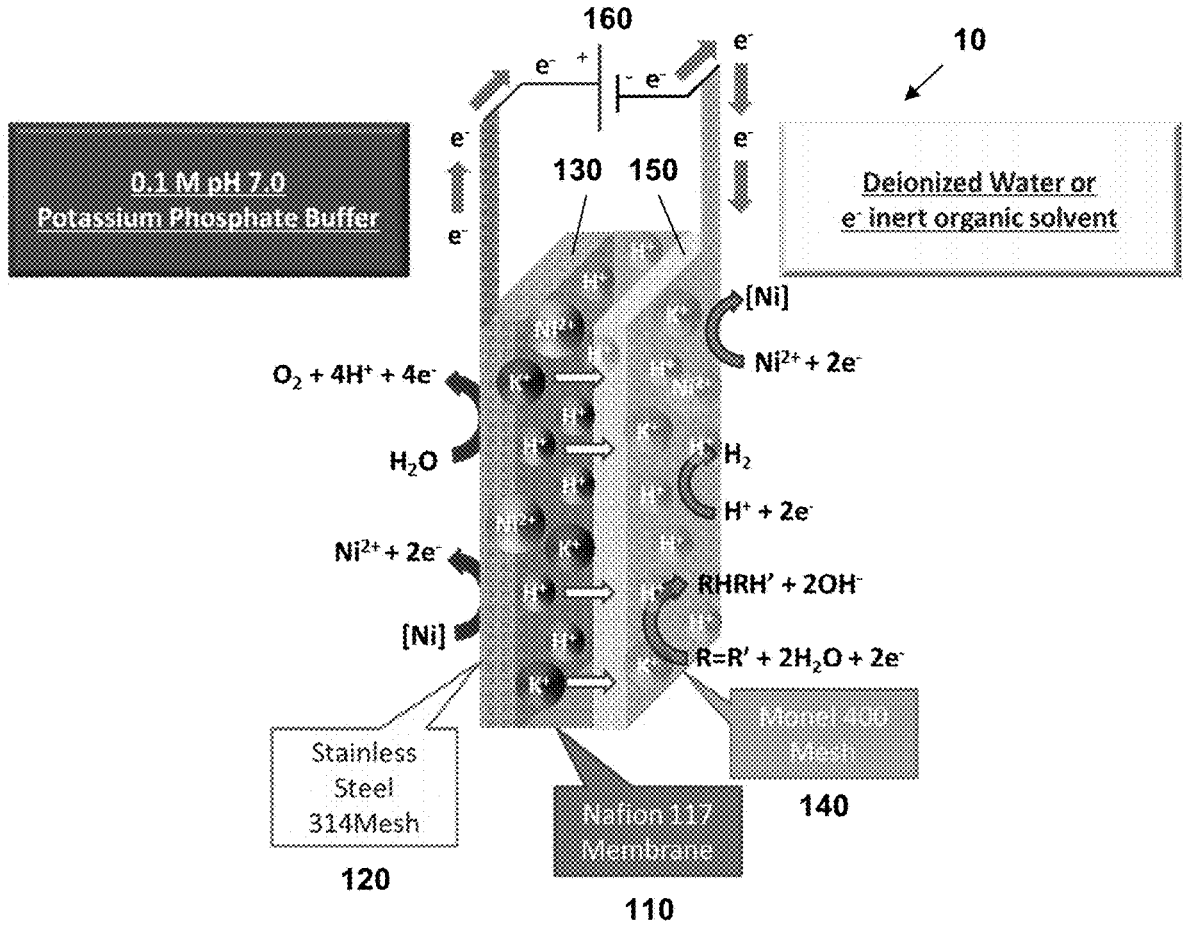
FIG. 6 is an illustration of a solid polymer electrolyte electrolyzer along with representative reactions according to the disclosure.

FIG. 6 illustrates features of the SPE electrolyzer cell used in Example 2, in particular the membrane electrode assembly for the SPE cell. The electrical current drives the chemical reduction processes. On the anode side (left), the SPE electrolyzer is equipped with a catalytic anode (stainless steel 314 mesh) which oxidizes water as shown to provide electrons ($e^-$) and protons ($H^+$) for the reduction. Electrons are collected by the current collector and driven to the catalytic cathode (MONEL copper-nickel alloy metallic mesh; right) through the circuit while protons travel to the cathode compartment through the proton exchange membrane (NAFION 117 solid polymer electrolyte). The protons ($H^+$) serve as charge-carriers in the cell medium. Dissolved organic compound reactant (e.g., a bio-oil constituent) reaches the cathode surface and there gains electrons and protons to undergo a reduction reaction (e.g., hydrogenation as illustrated). The process needs no conductive electrolyte in the cathode compartment for proton transportation as the cathode is already on the membrane surface. In the illustration, a generic unsaturated hydrocarbon R═R' is electrochemically hydrogenated to HR—R'H without added electrolyte. The catholyte solution including the reactant R═R' can either be a fixed volume of solution or a flowing stream depending on the application. Moreover the system is sealed tight enough that it can run under pressure and at elevated temperature (i.e., below the membrane melting temperature; e.g., 200° C. for NAFION 117). The two catalytic metallic meshes (stainless steel anode, copper-nickel alloy cathode) are freestanding structures mechanically held in physical contact against the membrane surface, such as by an external housing for the membrane electrode assembly. The metallic meshes are not adhered to the membrane surface (e.g., by hot pressing as with a carbon paper catalyst substrate) and they have sufficient catalytic activity themselves (i.e., they do not need additional catalytic materials deposited thereon, although either or both meshes could have additional catalytic materials deposited thereon if desired for improved activity towards various organic substrates).

Effect of Anolyte on Current Efficiency Improvement.

Figure 7:
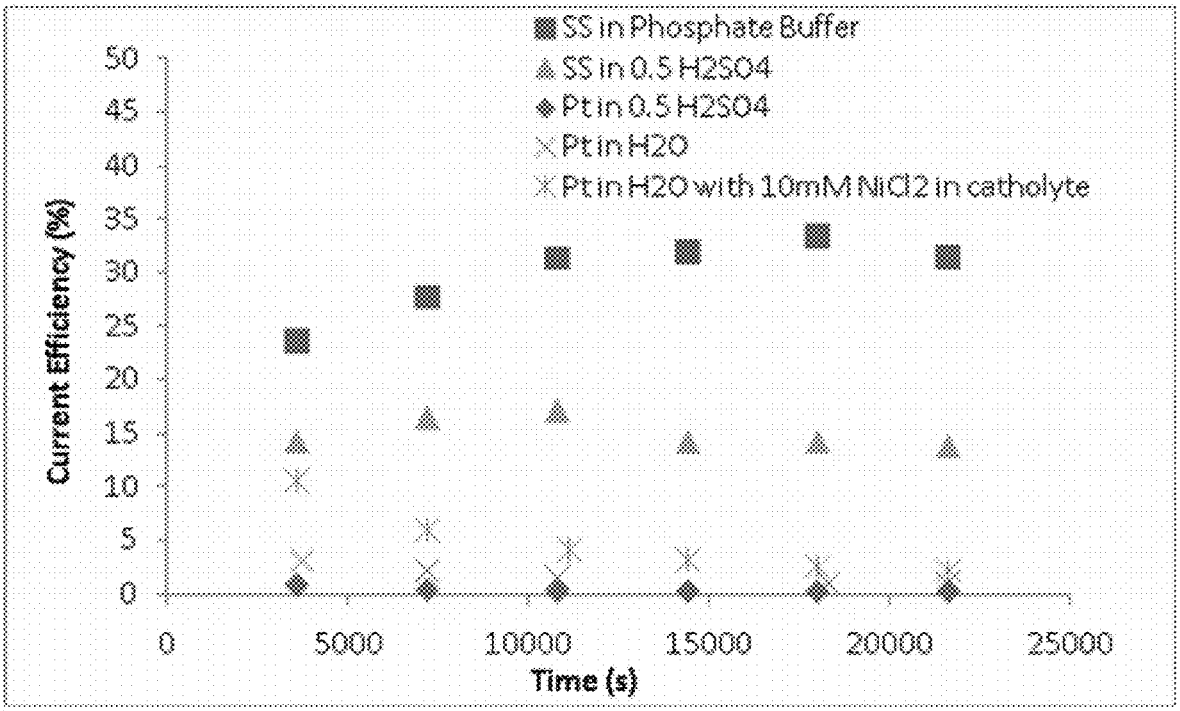
FIG. 7 is a graph illustrating the current efficiency for ECH of 10 ml of 5% acetol with 5% (v./v.) glacial acetic acid added. Condition: MONEL 400 catalytic surface at 98±2 mA at 1 atm at room temperature (22±1° C.) for 6 hours, with the anode compartment conditions indicated in the legend.
Figure 8:
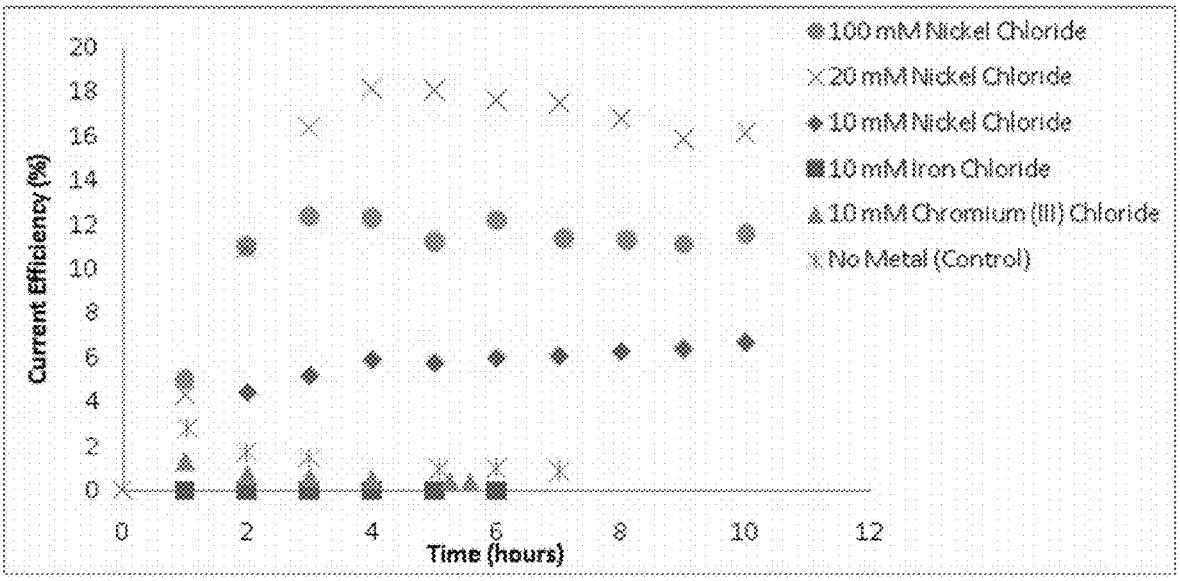
FIG. 8 is a graph illustrating the current efficiency for ECH of 100 ml of 5% acetol with 5% (v/v) glacial acetic acid added. Condition: MONEL 400 mesh 200 catalytic surface at 98±2 mA at 1 atm at room temperature (22±1° C.) with a platinum mesh anode in deionized water for 6-12 hours. Metal salts were added at the beginning of the experiment.

When the copper mesh cathode was replaced with the MONEL 400 mesh, the efficiency reached to well over 30% (FIG. 7, stainless steel anode indicated by SS in phosphate buffer), suggesting that the nickel-copper alloy was responsible for the catalytic enhancement. However, when the MONEL 400 mesh was used with a platinum mesh anode, which gave no nickel ions, the efficiency decreased dramatically to less than 5% (FIG. 7, Pt in $H_2O$). Therefore, the re-deposition of the nickel ions, which were leached from the stainless steel anode, was a contributing factor towards the catalytic enhancement, even when nickel was originally present in the cathode mesh. To illustrate the role of nickel, in a separate trial, 10 mM of nickel chloride was added to the catholyte with platinum used as the anode. As shown, the initial efficiency improved (FIG. 7, Pt in $H_2O$ with 10 mM $NiCl_2$ at 10.6% vs. Pt in $H_2O$ at 3.1% without an added nickel salt). The fall of the efficiency is likely owing to the small quantity of nickel ions that were then plated out in the 10 ml electrolyte. In 10 ml of 10 mM of nickel ion solution, there is only 0.1 mmol of nickel ions, which would require 19.3 coulombs to plate out. Given that a 6-hour electrolysis would supply roughly of 2000 coulombs, and assuming of 30% went into acetol hydrogenation, there is still 70% of the 2000 coulombs (2000×70%=1400 C) going towards $H_2$ formation and nickel plating. Thus the nickel ions in 10 ml of 10 mM nickel solution are depleted well before the reaction is over. When the solution volume was increased to 100 mL, there were 10 times more nickel ions in the solution to improve the supply of nickel ions. In a sufficient nickel supply environment, the reaction gave a steadier current efficiency trend as shown in FIG. 8.

The effect of anolyte pH on current efficiency was also examined. When the stainless steel anode was used with 0.5 M $H_2SO_4$, the current efficiency dropped significantly compared to the trials with the potassium phosphate buffer. Apparently, when there was a high influx of protons from the anode compartment, the cathode surface concentration of protons increased, favoring $H_2$ formation which in turn decreased the current efficiency. In other words, a non-proton cation flux would improve the current efficiency by lowering the proton concentration on the cathode surface. This was illustrated by the high current efficiency boost using potassium phosphate buffer anolyte (e.g., where the potassium cation represents an illustrative non-proton, metal cation flux through the membrane). When the stainless steel mesh anode was used in phosphate buffer solution, the initial current efficiency was 9.5% higher than using it in 0.5 M sulfuric acid. The differences increased to 17.6% after 6 hours of electrolysis shown in FIG. 7. In the beginning, the influx of potassium ions decreased the proton concentration on the cathode surface, and reduced the rate of $H_2$ formation. The higher efficiency after 6 hours of electrolysis may result from the potassium ion influx replacing $H^+$ ions and thus increasing the pH of the cathode solution; higher pH disfavors $H_2$ formation, and forces reaction to favor organic ECH under the constant current electrolysis setting.

Influence of Metal Ion Re-Deposition.

Aside from nickel, the current efficiency improvement due to other metals that could have been leached from the stainless steel mesh was also examined. Stainless steel (314) mesh includes about 0.03% sulfur, 0.05% phosphorus, 0.08% carbon, 0.10% of nitrogen, 0.75% silicon, 2.0% Manganese, 8-10% nickel, 18-20% chromium, and (remaining) 67.3-71.8% of iron (all w/w). Of the listed composition, only nickel, chromium and iron could be re-deposited on the cathode. Therefore, chromium (II) acetate and chromium (III) acetate (from air oxidation of chromium (II) acetate) and iron (III) chloride and several different concentrations of nickel (II) chloride were tested and compared for their improvement on current efficiency.

Only the nickel salts had a positive impact on the current efficiency. Of the three concentrations tested (10, 20, and 100 mM,) the 20 mM of nickel chloride trial reached its highest current efficiency to 18%, and then declined slowly. The 10 and 100 mM trial maintained a reasonable flat line after reaching its plateau. The increases in efficiency between 10 to 20 mM of nickel chloride is reasonable, double the concentration led to approximately 2.5 times greater efficiency. However, when the nickel ion concentration got too high in the 100 mM trial, the efficiency was lower than that of 20 mM, possibly resulting from competition between nickel ions and the organic substrate for reduction. Compared to the nickel (II) ions, chromium (III) and iron (III) ions decreased the current efficiency. EDX surface analysis showed only nickel was deposited on the copper mesh, but not the other two metals. The lack of plating of iron and chromium illustrates that the nickel deposition was a factor towards catalytic improvement of acetol hydrogenation, even when the cathode mesh (MONEL in this case) originally includes nickel (e.g., as representative of a catalytically active metal transported from the anode to the cathode during reactor operation to improve reactor efficiency).

Figure 9:
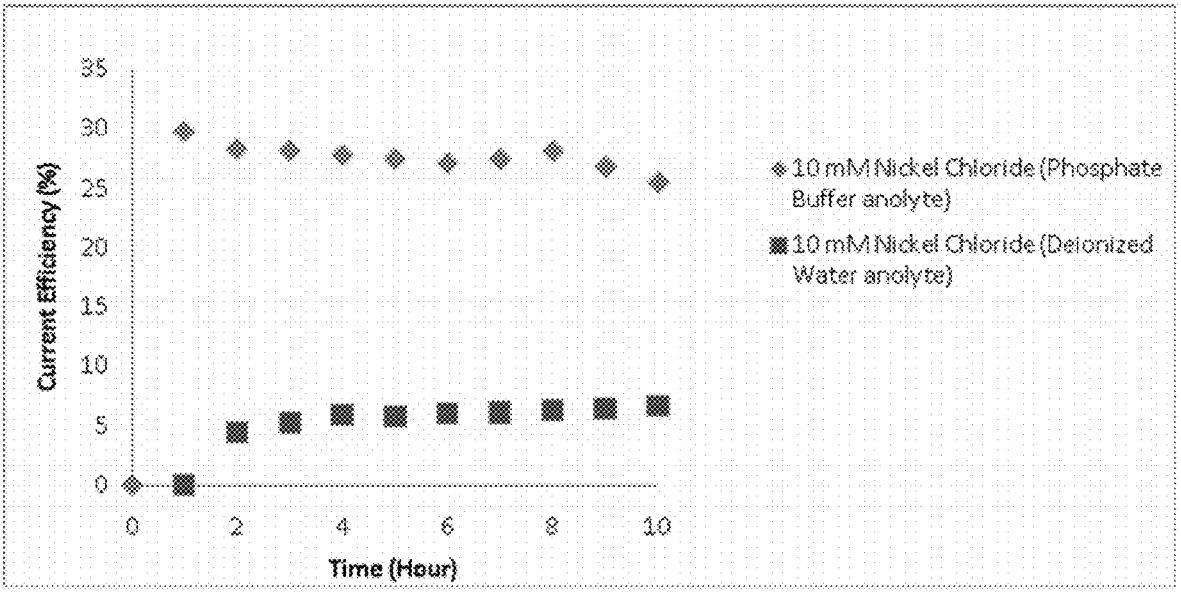
FIG. 9 is a graph illustrating the current efficiency for ECH of 100 ml of 5% acetol with 5% (v/v) glacial acetic acid added. Condition: MONEL 400 mesh 200 catalytic surface at 98±2 mA at 1 atm at room temperature (22±1° C.) with a platinum mesh anode in different anolytes for 12 hours.
Figure 10:
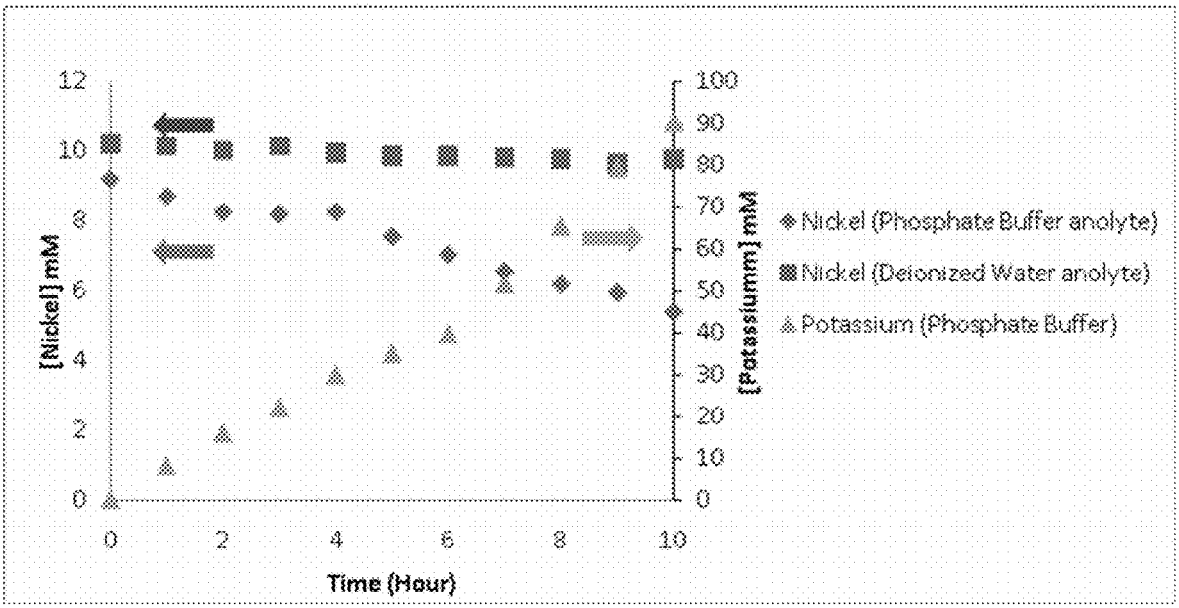
FIG. 10 is a graph illustrating the inductively coupled plasma/optical emission spectrometry (ICP-OES) analysis of nickel and potassium in the cathode solution for trials described in FIG. 9. Samples were diluted 125 times with 2% nitric prior analysis (0.2 ml of sample in 25 ml of 2% nitric acid).

Individually, potassium ions influx and nickel plating improved current efficiency, so the two factors were tested together. From FIG. 9, the use of phosphate buffer anolyte had a significantly higher current efficiency compared to deionized water anolyte—a boost of almost 25%. With phosphate buffer, the efficiency started at above 30% and declined slowly, whereas the current efficiency for the deionized water trial slowly rose. The difference in these trends is illustrated by combining the information from FIG. 9 and FIG. 10. Compared to the water anolyte, the nickel ion concentration dropped quicker in the presence of phosphate buffer anolyte, suggesting that a high influx of protons, generated via water splitting, from the anolyte was discouraging the nickel deposition and thus decreasing the current efficiency. The fact that the current efficiency did not correlate with the steady rise of potassium ion concentration, shown in FIG. 10, suggests the potassium ion did not have a direct effect in aiding the reduction. The constant influx of potassium, however, could have created cathode-local environment favoring nickel deposition, which in turn improved current efficiency. As shown, the combination of potassium influx and nickel ion deposition were significant factors in improving current efficiency.

Mesh Size Effect on Current Density.

The effect of mesh size on current density was examined, and the results are shown in Table 2. Based on Table 2 there was no simple correlation between mesh number and current efficiency found. However, the mesh size had some impact on the material balance—the lower the mesh number, the greater the open area (i.e., increase NAFION membrane exposure), which increases the area for organic diffusion through the NAFION membrane. Mesh 16 and 22 only have 34% and 47% material balance respectively while mesh 100 and 200 have 72.2% and 69.1% respectively.

TABLE 2

Mesh Size Effect on Current Density

| Copper Mesh Size | Wire Thickness (inch) | % Open Area | Nafion Exposure (mesh open area) ($cm^2$) | Copper Exposure ($cm^2$) | Copper/Nafion Exposure ratio | Acetol Remaining (mM) | Propylene glycol Formed (mM) | Current Efficiency (%) | Material Balance (%) |
|---|---|---|---|---|---|---|---|---|---|
| 16 | 0.011 | 67.9 | 3.59 | 1.7 | 0.47 | 178 | 154 | 13.2 | 47.1 |
| 22 | 0.012 | 51.47 | 2.72 | 2.57 | 0.94 | 43 | 197 | 17.3 | 34.0 |
| 100 | 0.0045 | 30.25 | 1.60 | 3.69 | 2.31 | 418 | 162 | 14.5 | 72.2 |
| 200 | 0.0022 | 31.36 | 1.66 | 3.63 | 2.19 | 214 | 244 | 21.9 | 69.1 |

Notes:
ECH of 10 ml of 5% acetol with 5% (v/v) glacial acetic acid added.
Condition: copper mesh with various mesh size at 98 ± 2 mA at 1 atm at room temperature (22 ± 1° C.) for 6 hours.
Mesh size is 2.3 × 2.3 cm (5.29 $cm^2$).

Effect of Current Density on Current Efficiency.

Two other current settings were selected to explore the effect of current density using the MONEL 400 mesh 200 and the results are summarized in Table 3. 200 mA has a lower current efficiency, which might be due to the higher current density was favoring $H_2$ formation over the ECH of organics. The average applied voltage for 200 mA was 3.85 (average of initial and final voltage); 41.5% higher than the average applied voltage of the 100 mA trial. The increase in voltage is required to drive the higher current which means in turn, that more reactions must take place on the electrode surface and hence a higher voltage is required to generate a thicker double layer. The material balance was also higher for the 200 mA trial. This is most likely due to a higher concentration of $H_2$ gas formed on the surface, and the bubbles increase the shielding between the cathodic solution and the membrane. In short, the 200 mA trial gave an 8% improvement on the material balance compared to the 100 mA; but required a 41.5% greater voltage. Hence, 98±2 mA was a better current setting for the reaction. When 50 mA was applied to the reaction, the applied potential got slightly lowered but the current efficiency (C.E.) decreased dramatically down to 6.7%. From the standpoint of the current, a lower applied current would lead to less adsorbed hydrogen on the surface and the adsorbed organics would be less likely to encounter an adsorbed hydrogen atom to achieve hydrogenation.

sium transported from the anode compartment can be removed easily with aqueous extraction. Thus, the SPE electrolyzer is an efficient and cost-effective strategy for bio-oil upgrading.

Aspects of current efficiency enhancement are summarized in Table 4. Estimations are given based on comparison between trials that have only one changed variable. In general, the surface acidity appears to have the greatest impact; lower pH tends to favor more $H_2$ formation than organic hydrogenation as expected. The situation can be averted with salted anolyte to provide an aprotic cation influx to discourage $H_2$ formation. However, the presence of acetic acid is a great challenge toward hydrogenation; the formation of $H_2$ gas is an inefficient reaction pathway for the electrons (i.e., which are preferably consumed for organic

TABLE 3

Current Density Effect on Current Efficiency

| Average Applied Current (mA) | Current Density (mA cm$^{-2}$) | Time (s) | Charge passed (C) | Average applied potential (V) | Acetol remained (mM) | P.G. formed (mM) | C.E. (%) | Material Balance (%) |
|---|---|---|---|---|---|---|---|---|
| 48.7 | 9.21 | 29280 | 1422.9 | 2.67 | 429 | 49 | 6.7 | 67.9 |
| 99.8 | 18.87 | 14400 | 1438.7 | 2.72 | 214 | 244 | 21.9 | 69.1 |
| 195.0 | 36.86 | 7200 | 1404.0 | 3.85 | 420 | 121 | 16.7 | 76.9 |

Notes:
ECH of 10 ml of 5% acetol with 5% (v/v) glacial acetic acid added.
Condition: MONEL 400 mesh 200 at different current density (mA cm$^2$) 1 atm at room temperature (22 ± 1° C.).
Note:
charge passed was calculated by the summation of multiplying current level (recorded hourly) with the time interval between sampling time.
Current density was calculated based on the cut dimension of 2.3 × 2.3 cm (5.29 cm$^2$).

Summary:

In Example 2, the stainless steel anode surface is first oxidized and releases nickel ions. The nickel ions, potassium ions, and hydrogen ions travel through the NAFION membrane to reach the cathode surface. The influx of potassium ions create a less acidic catholyte solution which favors the deposition of nickel. Freshly deposited nickel in turn favors organic hydrogenation and improves the current efficiency.

From an energy standpoint, the SPE electrolyzer is a better system than the conventional electrolyzer because it compound reduction), but it also creates a thin gas layer that may shield the catholyte from the membrane surface. In some aspects, however, the formation of $H_2$ is not entirely wasteful, because $H_2$ is a valuable commodity that carries high fuel value, which can be used to fuel the pyrolysis process shown in FIG. 11 as part of a electrolyzer system 50 including both an electrolyzer reactor 10 and pyrolysis reactor 30.

TABLE 4

Factors Enhancing Current Efficiency for Organic Substrate Reduction

| | $K^+$ influs to lower surface acidity | Presence of acetic acid | Nickel ion re-deposition | Acidic anolyte | Mesh Size | Current Density |
|---|---|---|---|---|---|---|
| Enhance C.E. % | Yes | No | Yes | No | N.A. | Depends |
| Qualitative Estimate | High | High | Moderate | Moderate | N.A. | Moderate |
| Estimate % | 20-25 | 20 | 10-15 | 15-20 | N.A. | Depends |

has a much smaller internal resistance. The classical dual compartment cell requires a minimal 5.5 volts to run at 50 mA at 75° C. (almost 9 volts at room temperature in 0.1 M borate buffer supporting electrolyte), whereas the SPE electrolyzer cell needs less than 3 volts to run at 100 mA at room temperature in a supporting electrolyte free environment. The energy aspect definitely makes the SPE electrolyzer system more appealing for catalytic hydrogenation in fuel production. The trace quantity of nickel ion deposited on the cathode is consumed by the reaction thereof, and the potas- Example 3

Example 3 illustrates the operation of an electrolyzer as generally illustrated in FIG. 2B for the reduction of acetol (i.e., as a model bio-oil reducible organic compound) to propylene glycol. As illustrated in FIG. 2B, a platinum wire was used as an electrode wire 120B and a copper tube 180 was used as a reactor housing for a PEM tube 170. Different metallic meshes 140 (e.g., as illustrated in FIG. 2B) and metallic powders 140A (e.g., as illustrated in FIG. 2A but applicable to the FIG. 2B embodiment) were evaluated for current efficiency, which provides an indication of the effectiveness of the system in catalyzing hydrogenation.

Figure 12:
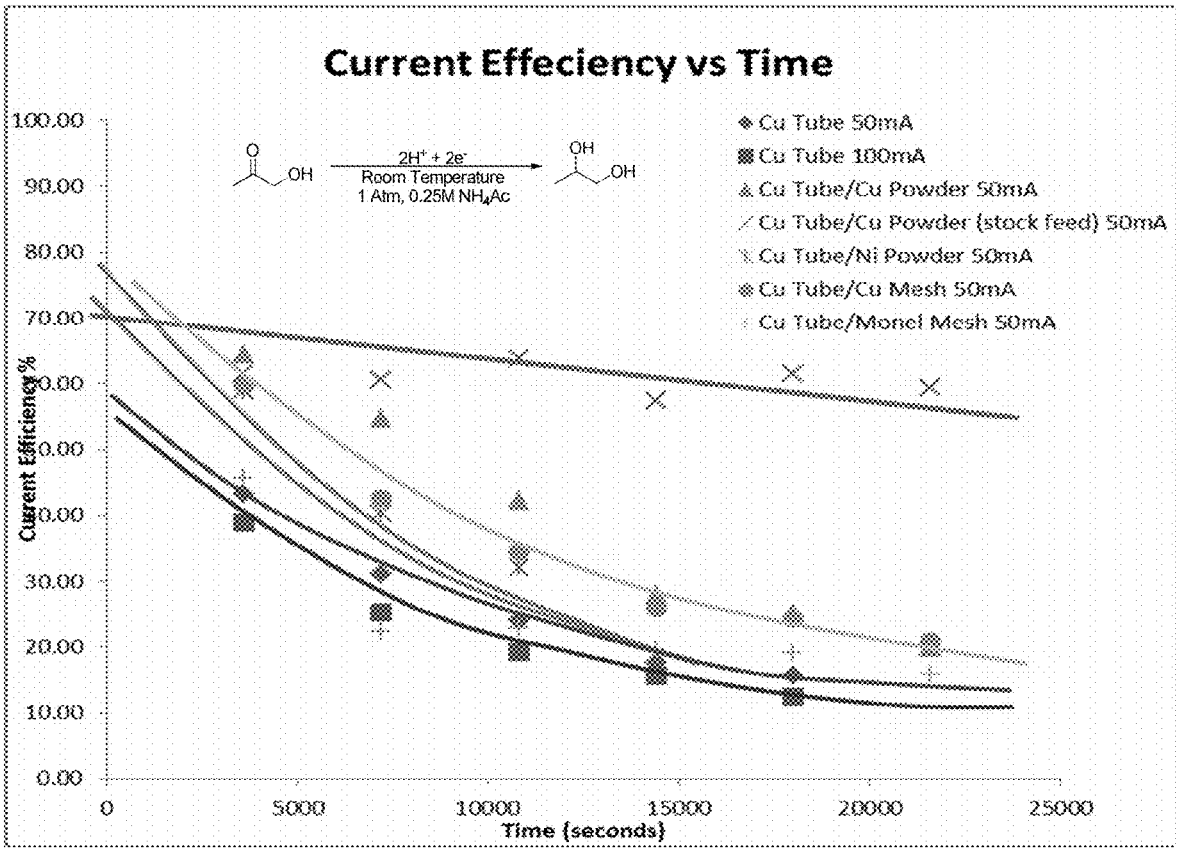
FIG. 12 is a graph illustrating the current efficiency for ECH of acetol in a tubular copper PEM reactor at 50 or 100 mA, 1 atm, and room temperature (22±1° C.) for 6 hours using various metallic mesh and metallic powder packings.

FIG. 12 illustrates the current efficiency as a function of reaction time, applied current, and electrocatalytic material in the annular tubular second reaction volume. Control experiments ("Cu Tube") were performed with a second reaction volume containing no metallic mesh or metallic powder packing at applied currents of 50 mA and 100 mA. Experiments with an electrolyzer according to the disclosure were performed with copper and nickel metallic powder packings ("Cu Powder" and "Ni Powder") in the second reaction volume at 50 mA applied current. Further experiments with an electrolyzer according to the disclosure were performed with freestanding copper and MONEL metallic meshes ("Cu Mesh" and "MONEL Mesh") in the second reaction volume at 50 mA applied current. The current efficiency was measured as described above and is shown in FIG. 12.

Because other modifications and changes varied to fit particular operating requirements and environments will be apparent to those skilled in the art, the disclosure is not considered limited to the example chosen for purposes of illustration, and covers all changes and modifications which do not constitute departures from the true spirit and scope of this disclosure.

Accordingly, the foregoing description is given for clearness of understanding only, and no unnecessary limitations should be understood therefrom, as modifications within the scope of the disclosure may be apparent to those having ordinary skill in the art.

All patents, patent applications, government publications, government regulations, and literature references cited in this specification are hereby incorporated herein by reference in their entirety. In case of conflict, the present description, including definitions, will control.

Throughout the specification, where the articles, compositions, processes, kits, or apparatus are described as including components, steps, or materials, it is contemplated that the compositions, processes, or apparatus can also comprise, consist essentially of, or consist of, any combination of the recited components or materials, unless described otherwise. Component concentrations can be expressed in terms of weight concentrations, unless specifically indicated otherwise. Combinations of components are contemplated to include homogeneous and/or heterogeneous mixtures, as would be understood by a person of ordinary skill in the art in view of the foregoing disclosure.

PARTS SUMMARY

10: (planar) electrolyzer reactor
20: (tubular) electrolyzer reactor
30: fast pyrolysis unit
50: electrolyzer system
100: membrane electrode assembly
110: (planar) proton exchange membrane (PEM)
112, 114, 116: first surface, second surface, and interior volume of PEM
30, 130, 230: microcapsules
120: first metallic mesh
120A: first metallic powder packing
120B: electrode wire
130: first reaction volume
132: first housing
134, 136: inlet, outlet to first reaction volume
140: second metallic mesh
140A: second metallic powder packing
150: second reaction volume
152: second housing
154, 156: inlet, outlet to second reaction volume
160: voltage or energy source
170: (tubular) proton exchange membrane (PEM)
180: (tubular) housing

REFERENCES

1. Saffron et al. International Publication No. WO 2013/134220
2. Jackson et al. U.S. Publication No. 2014/0110268

What is claimed is:

1. A method for reducing organic compounds, the method comprising:

(a) providing an electrolyzer reactor comprising:

(i) a membrane electrode assembly comprising: (A) a proton exchange membrane (PEM) having a first surface and a second surface opposing the first surface, (B) a freestanding first metallic mesh in physical contact with, but not fixedly attached to, the first PEM surface and having electrocatalytic activity for water oxidation and hydrogen ion formation, and (C) a freestanding second metallic mesh in physical contact with, but not fixedly attached to, the second PEM surface and having electrocatalytic activity for reduction of one or more organic compounds, wherein the first metallic mesh and the second metallic mesh are in electrical contact with each other via a voltage source for driving electrons therebetween, and the second metallic mesh is the only material that is in physical contact with the second PEM surface and that has electrocatalytic activity for reduction of the one or more organic compounds;

(ii) a first reaction volume in fluid communication with (A) the first metallic mesh and (B) the first PEM surface; and (iii) a second reaction volume in fluid communication with (A) the second metallic mesh and (B) the second PEM surface (b) applying a voltage potential to the voltage source in electrical connection with the first metallic mesh and the second metallic mesh to drive the electrons from the first metallic mesh to the second metallic mesh;

(c) supplying water to the first reaction volume, thereby oxidizing the water to form oxygen, hydrogen ions transported to the second reaction volume through the PEM, and electrons transported from the first metallic mesh to the second metallic mesh; and (d) supplying at least one reducible organic compound to the second reaction volume, thereby reducing the organic compound with the electrons transported to the second metallic mesh.

2. The method of claim 1, wherein the first metallic mesh and the second metallic mesh are free from catalytic materials thereon.

3. The method of claim 1, wherein the first metallic mesh comprises a catalytic material thereon.

4. The method of claim 1, wherein:

(i) the first reaction volume is defined by a first housing; and (ii) the second reaction volume is defined by a second housing.

5. The method of claim 1, wherein:

(i) the PEM is in the form of a tube, the first PEM surface being the tube interior surface and the second PEM surface being the tube exterior surface;

(ii) the PEM tube defines the first reaction volume as a tubular volume containing the first metallic mesh therein; and (iii) the second reaction volume is defined by an outer shell as an annular volume between the outer shell and the PEM tube and containing the second metallic mesh therein.

6. The method of claim 1, wherein (i) the first metallic mesh comprises stainless steel; and (ii) the second metallic mesh comprises an alloy comprising copper and nickel.

7. The method of claim 1, wherein the second metallic mesh has electrocatalytic activity for catalyzing at least one of (i) electrocatalytic hydrogenation (ECH) of unsaturated carbon-carbon bonds in the organic compound, (ii) ECH of carbon-oxygen double bonds in the organic compound, and (iii) electrocatalytic hydrodeoxygenation (ECHDO) of carbon-oxygen single bonds in the organic compound.

8. The method of claim 1, wherein the second metallic mesh has electrocatalytic activity for reduction of one or more organic compounds comprising one or more functional groups selected from the group consisting of carbonyl carbon-oxygen double bonds, aromatic double bonds, ethylenic carbon-carbon double bonds, acetylenic carbon-carbon triple bonds, hydroxyl carbon-oxygen single bonds, ether carbon-oxygen single bonds, and combinations thereof.

9. The method of claim 1, wherein the first metallic mesh comprises at least one metal component having electrocatalytic activity for reduction of the one or more organic compounds.

10. The method of claim 1, wherein the first metallic mesh and the second metallic mesh each comprise the same metal.

11. The method of claim 1, wherein the proton exchange membrane (PEM) comprises a perfluorocarbon sulfonate polymer.

12. The method of claim 1, wherein the water supplied to the first reaction volume comprises an electrolyte.

13. The method of claim 1, further comprising supplying water to the second reaction volume.

14. The method of claim 1, wherein the second reaction volume is free from added electrolytes.

15. The method of claim 1, wherein the at least one reducible organic compound supplied to the second reaction volume comprises one or more functional groups selected from the group consisting of carbonyl carbon-oxygen double bonds, aromatic double bonds, ethylenic carbon-carbon double bonds, acetylenic carbon-carbon triple bonds, hydroxyl carbon-oxygen single bonds, ether carbon-oxygen single bonds, and combinations thereof.

16. The method of claim 1, comprising supplying a plurality of reducible organic compounds to the second reaction volume, thereby reducing the plurality of organic compounds with the electrons transported to the second metallic mesh, the plurality of organic compounds being selected from the group consisting of a multicomponent bio-oil, a multicomponent bio-oil fraction, a plurality of bio-oil components, and combinations thereof;

wherein the reduced plurality of organic compounds reaction product comprises an upgraded bio-oil product.

17. The method of claim 1, wherein:

the at least one reducible organic compound supplied in part (d) comprises a plurality of bio-oil pyrolysis products selected from the group consisting of acetol, hydroxyacetaldehyde, glyoxal, formaldehyde, acetic acid, phenol, guaiacol, syringol, levoglucosan, furfural, glucose, xylose, substituted derivatives thereof, and combinations thereof; and part (d) comprises reducing the plurality of bio-oil pyrolysis products with the electrons transported to the second metallic mesh.

18. The method of claim 1, wherein the reduced at least one organic compound reaction product comprises one or more of ethylene glycol, propylene glycol, cyclohexanol, furfuryl alcohol, and methanol.

19. The method of claim 1, wherein:

the at least one reducible organic compound supplied in part (d) comprises a plurality of lignin depolymerization products selected from the group consisting of phenolic methoxylated monomers, phenolic methoxylated oligomers having 2-10 phenolic residues, and combinations thereof resulting from depolymerization of lignin-containing biomass; and part (d) comprises reducing the plurality of lignin depolymerization products with the electrons transported to the second metallic mesh.

20. The method of claim 1, further comprising: (e) recovering or separating the organic compound resulting from reduction in part (d) from the second reaction volume.

21. The method of claim 1, further comprising: (e) recovering or separating hydrogen gas generated during organic compound reduction from the second reaction volume and feeding the hydrogen gas to a biomass fast pyrolysis reactor.

22. The method of claim 1, wherein part (d) comprises reducing the organic compound at a temperature ranging from 0° C. to 100° C. and at a pressure ranging from 0.8 atm to 1.2 atm.

23. The method of claim 1, wherein:

the first metallic mesh is not hot-pressed to the first PEM surface with a binding agent; and the second metallic mesh is not hot-pressed to the second PEM surface with a binding agent.

24. The method of claim 1, wherein:

the first metallic mesh comprises first metal wires formed from a metal or metal alloy, the first metal wires having sufficient catalytic activity themselves for water oxidation and hydrogen ion formation; and the second metallic mesh comprises second metal wires formed from a metal or metal alloy, the second metal wires having sufficient catalytic activity themselves for the reduction of one or more organic compounds.

25. The method of claim 24, wherein the second PEM surface is free from catalytic electrode materials fixedly attached thereto.

26. The method of claim 1, wherein the PEM is free from catalytic electrode materials fixedly attached thereto.

* * * * *